US005584184A

United States Patent [19]

Inaguchi et al.

[11] Patent Number: 5,584,184

[45] Date of Patent: Dec. 17, 1996

[54] SUPERCONDUCTING MAGNET AND REGENERATIVE REFRIGERATOR FOR THE MAGNET

[75] Inventors: Takashi Inaguchi; Itsuo Kodera; Akinori Ohara; Toshiyuki Amano, all of Amagasaki; Takeo Kawaguchi, Kobe, all of Japan

[73] Assignee: Mitsubishi Denki Kabushiki Kaisha, Tokyo, Japan

[21] Appl. No.: 420,681

[22] Filed: Apr. 12, 1995

[30] Foreign Application Priority Data

Apr. 15, 1994 [JP] Japan ..... 6-077387

[51] Int. Cl.[6] ..... F25B 9/00

[52] U.S. Cl. ..... 62/6; 62/51.1

[58] Field of Search ..... 62/6, 51.1

[56] References Cited

U.S. PATENT DOCUMENTS

| | | | |
|---|---|---|---|
| 4,277,949 | 7/1981 | Longsworth | 62/51.1 X |
| 4,510,771 | 4/1985 | Matsuda et al. | 62/51.1 |
| 5,150,578 | 9/1992 | Oota et al. | 62/51.1 X |
| 5,154,063 | 10/1992 | Nagao et al. . | |
| 5,381,666 | 1/1995 | Saho et al. | 62/51.1 X |

FOREIGN PATENT DOCUMENTS

| | | | |
|---|---|---|---|
| 2-298765 | 12/1990 | Japan . | |
| 4044202 | 2/1992 | Japan | 62/51.1 |
| 5-136469 | 6/1993 | Japan . | |

*Primary Examiner*—Christopher Kilner
*Attorney, Agent, or Firm*—Burns, Doane, Swecker & Mathis, LLP

[57] ABSTRACT

Superconducting magnet and regenerative refrigerator can be reduced in size of the apparatus and is capable reducing the evaporating amount of liquid helium. A coil portion second thermal shield 17*a* and a coil portion thermal shield 8*a* are disposed so as to enclose a coil portion helium tank 2*a* which contains superconducting coil 1. Further, a helium portion second thermal shield 17*b* and a helium reservoir portion thermal shield 8*b* are disposed so as to enclose a helium reservoir tank 2*b* which stores liquid helium 3. A coil portion second thermal shield 17*a* and a coil portion thermal shield 8*a* are cooled by a coil portion 2-stage type Gifford-McMahon cycle refrigerator 50*a* while a helium portion second thermal shield 17*b* and a helium reservoir portion thermal shield 8*b* are cooled by a helium reservoir portion 2-stage type Gifford-McMahon cycle refrigerator 50*b*.

11 Claims, 28 Drawing Sheets

SUPERCONDUCTING MAGNET AND REGENERATIVE REFRIGERATOR FOR THE MAGNET

BACKGROUND OF THE INVENTION

1. Field of the Invention

The present invention relates to superconducting magnet and regenerative refrigerator mounted on the superconducting magnet and, more particularly, relates to a superconducting magnet capable of achieving easy maintenance and reduction in size and weight and to a regenerative refrigerator of an improved refrigerating capacity.

2. Description of the Related Art

FIG. 26 is a sectional view showing an example of conventional superconducting magnet, for example, disclosed in Japanese Patent Laid-Open Publication No.5-136469.

In this figure, superconducting coil 1 is contained in a coil portion helium tank 2*a* which serves as the coil portion cryogenic refrigerant tank. A helium reservoir tank 2*b* serving as the cryogenic refrigerant reservoir tank is disposed above the coil portion helium tank 2*a*. Further, the coil portion helium tank 2*a* and the helium reservoir tank 2*b* are in communication with each other through a helium piping 5. Liquid helium 3 serving as a cryogenic refrigerant is stored in the helium reservoir tank 2*b*. The interior of the coil portion helium tank 2*a* is filled with the liquid helium 3 which has been supplied through the helium piping 5 from the helium reservoir tank 2*b*. Therefore, the superconducting coil 1 contained within the coil portion helium tank 2*a* is immersed in the liquid helium 3 so as to be maintained at a very low temperature.

A coil portion thermal shield 8*a* is disposed so as to enclose the coil portion helium tank 2*a*, and a helium reservoir portion thermal shield 8*b* is disposed so as to enclose the helium reservoir tank 2*b*. Thus, heat penetration into the coil portion helium tank 2*a* and the helium reservoir tank 2*b* is reduced by the coil portion thermal shield 8*a* and the helium reservoir portion thermal shield 8*b*. A liquid nitrogen container 6 is filled with liquid nitrogen 7 serving as a freezing mixture and is thermally connected to the helium reservoir portion thermal shield 8*b*. A liquid nitrogen cooling pipe 9 is disposed such that it is wound around the coil portion thermal shield 8*a* in its state of thermal contact thereto. One end of the liquid nitrogen cooling pipe 9 is in communication with the bottom of the liquid nitrogen container 6 and the other end (not shown) thereof is in communication with a vapor-phase portion 6*a* at an upper portion of the liquid nitrogen container 6.

A vacuum tank 10 is disposed so that it furthermore encloses the coil portion thermal shield 8*a* and the helium reservoir portion thermal shield 8*b* which are disposed to enclose the coil portion helium tank 2*a* and the helium reservoir tank 2*b*. The coil portion helium tank 2*a* is then supported by a plurality of supports 11 adiabatically with respect to the vacuum tank 10.

A Joule-Thomson cycle refrigerator 12 for liquefying the evaporated helium gas within the helium reservoir tank 2*b* comprises: a compressor 13; a precooler 14 for cooling a room-temperature, high-pressure helium gas supplied from the compressor 13 by means of the helium gas which has been fed back at a low temperature and low pressure; a Joule-Thomson valve 15 for allowing an equi-enthalpy expansion of the high-pressure, low-temperature helium gas having been cooled to a predetermined temperature to occur substantially to the level of atmospheric pressure, thereby liquefying a part of the expanded gas; and a condenser 16 disposed in the vapor-phase portion at an upper portion of the helium reservoir tank 2*b*, for condensing and liquefying the evaporated helium gas within the helium reservoir tank 2*b* by the liquid helium generated at the Joule-Thomson valve 15.

A description will now be given with respect to operation of the above conventional superconducting magnet.

The superconducting coil 1 is cooled to a very low temperature (for example 4.2K) by the liquid helium 3 within the coil portion helium tank 2*a* and is brought into the so-called superconductive state where electric resistance is zero. An excitation current is then supplied through a current lead (not shown) to the superconducting coil 1 from an external power supply (not shown) provided for the superconducting magnet so as to generate a required magnetic field.

The helium reservoir portion thermal shield 8*b* is cooled to a temperature of the order of 80K by means of thermal conduction from the liquid nitrogen container 6 which is filled with the liquid nitrogen 7. Further, the liquid nitrogen 7 cools the coil portion thermal shield 8*a* by cycling through the liquid nitrogen cooling pipe 9.

Thus, heat penetration into the helium reservoir tank 2*b* and the coil portion helium tank 2*a* is reduced, since, in addition to vacuum insulation provided by the vacuum tank 10, radiated heat is cut oil by the helium reservoir portion thermal shield 8*b* and the coil portion thermal shield 8*a*.

Further, the supports 11 are disposed between the superconducting coil 1 and the vacuum container 10 to bear the magnetic field generated by the superconducting coil 1 and the weight of the superconducting coil 1. Here, the supports 11 are provided with thermal anchor at the portion corresponding to the coil portion thermal shield 8*a* to reduce heat penetration.

However, it is impossible to completely prevent heat penetration and, as a result, the liquid helium 3 is continuously vaporized. The above described Joule-Thomson refrigerator 12 is thus driven to feed the liquid helium generated at Joule-Thomson valve 15 into the condenser 16 so as to condense and liquefy the vaporized helium gas. Thereby, evaporation of the liquid helium 3 in the helium reservoir tank 2*b* may be reduced, or the evaporated amount thereof may be zero.

Further, as another conventional example, a superconducting magnet as shown below has been proposed.

FIG. 27 is a cross sectional view showing another example of conventional superconducting magnet for example disclosed in Japanese Patent Laid-Open No. 2-298765. In this conventional superconducting magnet, a helium tank 2 containing the superconducting coil 1 in a manner immersing it in liquid helium 3 stored therein is enclosed by a second thermal shield 17. A thermal shield 8 is disposed so as to enclose the second thermal shield 17 and a vacuum tank 10 is disposed so as to furthermore enclose the thermal shield 8. Here, Gifford-McMahon cycle refrigerator 18, a type of regenerative refrigerator operating efficiently against impurities, is used, so that the thermal shield 8 is cooled by a first-stage heat stage 19 of the Gifford-McMahon cycle refrigerator 18, the second thermal shield 17 is cooled by a second-stage heat stage 20 and, furthermore, the helium tank 2 is cooled by a third-stage heat stage 21.

The construction of the above Gifford-McMahon cycle refrigerator 18 will now be described with reference to FIG. 28.

A cylinder 31 is constructed such that pipes having sequentially reduced diameters are coaxially connected and integrated to one another. A first-stage displacer 32 is slidably disposed on the first stage of the cylinder 31, a second-stage displacer 33 is slidably disposed on the second stage of the cylinder 31 in a similar manner as the first-stage displacer 32 and a third-stage displacer 34 is slidably disposed in a similar manner on the third stage of the cylinder 31. The first, second and third-stage displacers 32, 33, 34 are connected and integrated respectively by means of universal joints (not shown). A first-stage seal 35, second-stage seal 36 and third-stage seal 37 are respectively disposed between the first, second, third-stage displacers 32, 33, 34 and the respective stages of the cylinder 31, thereby preventing leakage of helium gas. The first-stage heat stage 19, second-stage heat stage 20 and third-stage heat stage 21 are respectively disposed on the outer peripheral surface of the low-temperature end of each stage of the cylinder 31. Spaces formed respectively between the end surfaces of the respective stages of the cylinder 31 and the first, second and third-stage displacers 32, 33, 34 constitute first-stage expansion space 44, second-stage expansion space 45 and third-stage expansion space 46. A first-stage regenerator 38 is constituted by filling the interior of the first-stage displacer 32 with a copper mesh as the regenerative material. A second-stage regenerator 39 is constituted by filling the interior of the second-stage displacer 33 with lead balls as the regenerative material. A third-stage regenerator 40 is constituted by filling the interior of the third-stage displacer 34 with Ho-Er-Ru as the regenerative material.

A helium piping for supplying/exhausting helium gas is attached to the Gifford-McMahon cycle refrigerator 18. A suction valve 41 is mounted on the supplying side of the helium piping as a valve mechanism, and timing for supplying a high-pressure helium gas compressed at the compressor 13 to the Gifford-McMahon cycle refrigerator 18 is controlled by the suction valve 41. An exhaust valve 42 is mounted on the returning side of the helium piping as a valve mechanism, and timing for exhausting the low-pressure helium gas to the compressor 13 from the Gifford-McMahon cycle refrigerator 18 is controlled by the exhaust valve 42. A driving motor 43 causes reciprocation of the first, second and third-stage displacers 32, 33, 34 within the cylinder 31. The suction valve 41 and the exhaust valve 42 are opened/closed in association with such reciprocating movement.

Operation of the Gifford-McMahon cycle refrigerator 18 constructed as described is as follows.

First, in the state where the first, second and third-stage displacers 32, 33, 34 are placed at the lowermost end and where the suction valve 41 is opened and the exhaust valve 42 is closed, a high-pressure helium gas compressed at the compressor 13 is supplied into the first, second and third-stage expansion spaces 44, 45, 46. As a result, a high-pressure state occurs in the first, second and third-stage expansion spaces 44, 45, 46.

Next, the first, second and third-stage displacers 32, 33, 34 are moved upward, and, accordingly, the high-pressure helium gas is sequentially supplied to the first, second and third-stage expansion spaces 44, 45, 46. In the meantime, the suction and exhaust valves 41, 42 are not moved. Thus, the high-pressure gas is cooled to a predetermined temperature by the respective regenerative materials when it passes through the first, second and third-stage regenerators 38, 39, 40.

When the first, second and third-stage displacers 32, 33, 34 reach the uppermost end, the suction valve 41 is closed and, shortly thereafter, the exhaust valve 42 is opened. At this time, the high-pressure helium gas is adiabatically expanded to cause refrigeration. The helium gas existing within the first, second and third-stage expansion spaces 44, 45, 46 is then brought to a low-temperature and low-pressure state at the respective temperature level.

Next, as the first, second and third-stage displacers 32, 33, 34 are moved downward, the low-temperature and low-pressure helium gas passes through the third, second and first-stage regenerators 40, 39, 38 and is exhausted from the exhaust valve 42. At this time, after cooling the regenerative materials respectively of the third, second and first-stage regenerators 40, 39, 38, the low-temperature and low-pressure helium gas is returned to the compressor 13.

Then, in the state where the first, second and third-stage displacers 32, 33, 34 are moved to the lowermost end to minimize the volume of the first, second and third-stage expansion spaces 44, 45, 46, the exhaust valve 42 is closed and the suction valve 41 is opened so that, as the high-pressure helium gas compressed at the compressor is supplied., the pressure of the first, second and third-stage expansion spaces 44, 45, 46 is increased from a low pressure to a high pressure. The above process constitutes one cycle of operation.

In this manner, the above operation is repeated so that temperatures of the first, second and third-stage heat stages 19, 20, 21 are cooled to 70K, 20K, 4.2K, respectively.

While the above description has been given with respect to a 3-stage type Gifford-McMahon cycle refrigerator 18, operation of a 2-stage type Gifford-McMahon cycle refrigerator is similar to the 3-stage type Gifford-McMahon cycle refrigerator 18 with an only exception that number of displacers, regenerators, seals and expansion spaces is changed from three to two, respectively. Here, if the above operation is repeated with a 2-stage type Gifford-McMahon cycle refrigerator, the first and second-stage heat stages are cooled to 50K and 4.2K, respectively.

As described, in the conventional superconducting magnet such as disclosed in Japanese Patent Laid-Open No.5-136469, since the coil portion thermal shield **8*a* and the helium reservoir portion thermal shield 8*b* are cooled by liquid nitrogen 7, replenishment of the liquid nitrogen 7 is required at suitable intervals. Since the liquid nitrogen container 6** must be provided, the superconducting magnet is increased in size to result in the problem of an increased weight thereof.

Further, since the coil portion thermal shield **8*a* and the helium reservoir portion thermal shield 8*b* cannot be brought to temperatures lower than the temperature of the liquid nitrogen, heat penetration due to conduction or radiation into the coil portion helium tank 2*a* and the helium reservoir tank 2*b* depends on the boiling point temperature (77K) of liquid nitrogen. As a result, there is a limitation in reducing the evaporating amount of liquid helium 3 within the coil portion helium tank 2*a* and the helium reservoir tank 2*b***.

Further, since the container for storing liquid helium 3 is divided into two locations at the coil portion helium tank **2*a* and the helium reservoir tank 2*b*, the thermal shield is constituted by the coil portion thermal shield 8*a* and the helium reservoir portion thermal shield 8*b*, resulting in a problem of heat resistance of the connecting portion when the two parts are thermally integrated through a heat transmission member. For this reason, if a conventional regenerative refrigerator is provided at the portion of the coil portion thermal shield 8*a*, the helium reservoir portion thermal shield 8*b* will not be adequately cooled and temperature thereof will be increased, whereby heat penetration into the helium reservoir tank 2***b* is increased. Further, if the conventional regenerative refrigerator is provided at the helium reservoir portion thermal shield 8*b*, the coil portion thermal shield 8*a* will not be adequately cooled and the temperature thereof will be increased, whereby heat penetration into the coil portion helium tank 2*a* is increased. In either case, problem occurs of an increased evaporation of liquid helium 3.

Further, while the Joule-Thomson cycle refrigerator 12 is provided to reduce the evaporating amount of liquid helium 3, clogging due to a small amount of impurities of the helium gas serving as the working fluid tends to occur at the small bore portion of the Joule-Thomson valve 15 in the Joule-Thomson cycle refrigerator 12. There are problems not only of difficulty of handling but also of higher costs due to the fact that the Joule-Thomson cycle refrigerator 12 itself has a complicated construction.

On the other hand, in the conventional superconducting magnet disclosed in Japanese Patent Laid-Open No. 2-298765, the Gifford-McMahon cycle refrigerator 18 which is efficient in dealing with impurities is used to reduce the evaporating amount of liquid helium 3. Therefore, clogging due to a small amount of impurities included in the helium gas is less likely to occur compared to the conventional superconducting magnet using the Joule-Thomson cycle refrigerator 12. Handling is easier and the construction is simpler whereby lower cost may be achieved. With the Gifford-McMahon cycle refrigerator 18, however, the most suitable cycle frequency (number of cycles per unit time) differs between the temperature (of the order of 4K) at the time of liquefying helium gas and the temperature (10K or higher) for cooling the thermal shield. Thus, if a cycle frequency suitable for cooling the thermal shield is adopted, capacity for liquefying helium gas is lowered. On the other hand, if a cycle frequency suitable for liquefying the helium gas is adopted, the cooling power for the thermal shield is reduced, whereby heat penetration into the helium tank 2 is increased to result in an increased evaporation of liquid helium 3.

Accordingly, the liquefying capacity for helium gas in the Gifford-McMahon cycle refrigerator 18 is not adequate and it is necessary to improve the liquefying capacity.

SUMMARY OF THE INVENTION

The present invention has been made to solve the above described problems. It is a first object of the present invention to obtain a superconducting magnet which may be reduced in size and is capable of reducing the evaporation of liquid helium.

Further, it is a second object of the present invention to obtain a regenerative refrigerator which may be applied to a superconducting magnet and has an excellent refrigerating capacity.

In order to achieve the above object, according to one aspect of the present invention, there is provided a superconducting magnet comprising: a superconducting coil; a coil portion cryogenic refrigerant tank for containing the superconducting coil and for storing a cryogenic refrigerant; a cryogenic refrigerant reservoir tank provided in communication with the coil portion cryogenic refrigerant tank for supplying the cryogenic refrigerant to the coil portion cryogenic refrigerant tank; a refrigerant reservoir portion thermal shield enclosing the cryogenic refrigerant reservoir tank; a coil portion thermal shield enclosing the coil portion cryogenic refrigerant tank; a vacuum tank enclosing the refrigerant reservoir portion thermal shield and the coil portion thermal shield; a regenerative refrigerator for cooling the refrigerant reservoir portion thermal shield; and a regenerative refrigerator for cooling the coil portion thermal shield.

According to another aspect of the present invention, there is provided a superconducting magnet comprising: a beam chamber; a pair of superconducting coils provided at upper and lower portions of the beam chamber in a thermally separated manner from each other; a coil portion cryogenic refrigerant tank for containing the superconducting coils and for storing a cryogenic refrigerant; a cryogenic refrigerant reservoir tank provided in communication with the coil portion cryogenic refrigerant tank for supplying the cryogenic refrigerant to the coil portion cryogenic refrigerant tank; a refrigerant reservoir portion thermal shield enclosing the cryogenic refrigerant reservoir tank; a coil portion thermal shield enclosing the coil portion cryogenic refrigerant tank; a vacuum tank enclosing the refrigerant reservoir portion thermal shield and the coil portion thermal shield; a regenerative refrigerator for cooling the refrigerant reservoir portion thermal shield; and a regenerative refrigerator for cooling the coil portion thermal shield.

According to another aspect of the present invention, there is provided a superconducting magnet comprising: a superconducting coil; a cryogenic refrigerant tank for containing the superconducting coil and for storing a cryogenic refrigerant; a thermal shield enclosing the cryogenic refrigerant tank; a vacuum tank enclosing the thermal shield; a regenerative refrigerator for cooling the thermal shield; and a regenerative refrigerator for liquefying evaporated gas of the cryogenic refrigerant with at least a portion of heat stage thereof being exposed to a vapor-phase portion of the cryogenic refrigerant tank.

According to another aspect of the present invention, there is provided a superconducting magnet comprising: a superconducting coil; a cryogenic refrigerant tank for containing the superconducting coil and for storing a cryogenic refrigerant; a thermal shield enclosing the cryogenic refrigerant tank; a vacuum tank enclosing the thermal shield; a regenerative refrigerator for cooling the thermal shield; and a regenerative refrigerator for cooling the cryogenic refrigerant tank by thermally connecting at least a portion of heat stage thereof to a wall surface of the cryogenic refrigerant tank. According to another aspect of the present invention, there is provided a regenerative refrigerator comprising: two stages of cylinders; two stages of displacers reciprocating within the two stages of the cylinders; first-stage and second-stage expansion spaces formed by the two stages of cylinders and the two stages of displacers; two stages of regenerators for effecting heat exchange of a gas flowing out/in from/to the first-stage and second-stage expansion spaces; a driving motor for causing the reciprocation of the two stages of displacers; a valve mechanism for controlling the flow of gas to the first-stage and second-stage expansion spaces; and a compressor for supplying the gas to the first-stage and second-stage expansion spaces; wherein the volume ratio of the first-stage expansion space to the second-stage expansion space is in the range of 0.45 to 0.28.

DETAILED DESCRIPTION OF THE PREFERRED EMBODIMENTS

Embodiment 1

Figure 1:
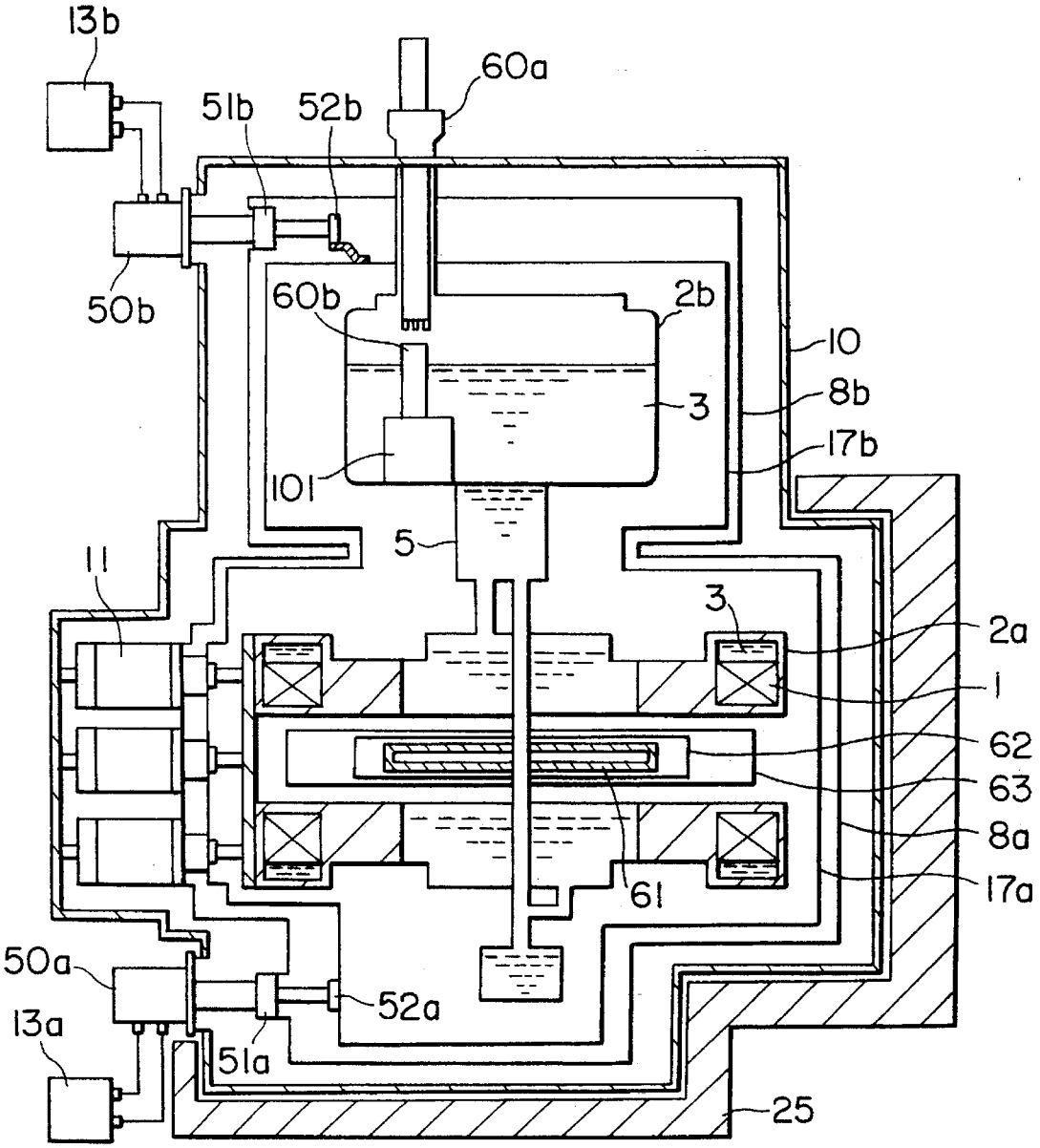
FIG. 1 is a sectional view showing a superconducting magnet according to Embodiment 1 of the present invention.
Figure 26:
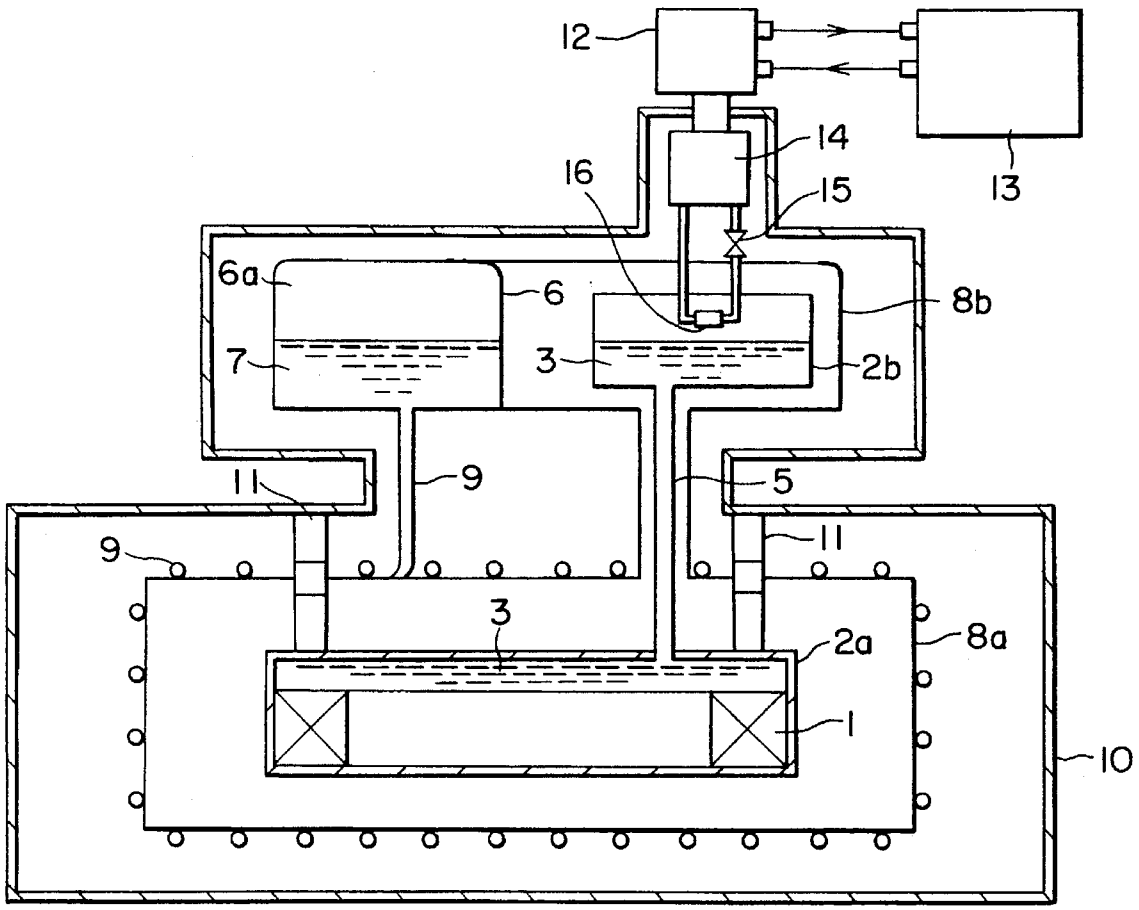
FIG. 26 PRIOR ART
FIG. 26 is a sectional view showing an example of conventional superconducting magnet.
Figure 27:
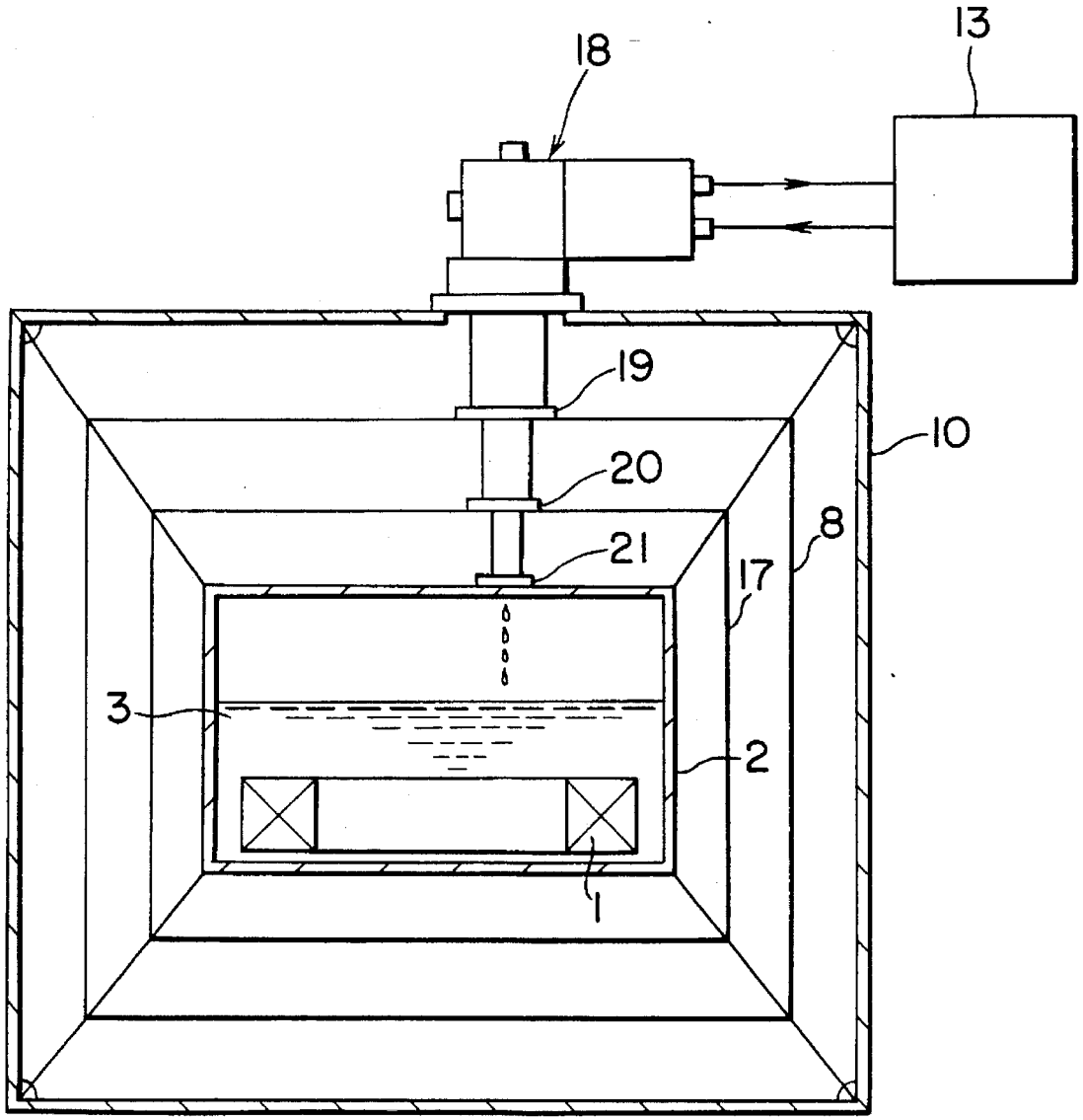
FIG. 27 PRIOR ART
FIG. 27 is a sectional view showing another example of conventional superconducting magnet.

In Embodiment 1, the present invention is applied to a superconducting magnet for a synchrotron radiation apparatus. FIG. 1 is a sectional view showing the superconducting magnet according to Embodiment 1 of the present invention. In this figure, identical or corresponding portions as in the conventional superconducting magnets as shown in FIGS. 26 and 27 are denoted by identical reference numerals and description thereof will be omitted.

In this figure, a coil portion second thermal shield 17*a* is disposed at the inside of a coil portion thermal shield 8*a* so as to enclose a coil portion helium tank 2*a*. Further, a helium reservoir portion second thermal shield 17*b* is disposed at the inside of the helium reservoir portion thermal shield 8*b* so as to enclose a helium reservoir tank 2*b*. A coil portion 2-stage type Gifford-McMahon cycle refrigerator 50*a* serving as the regenerative refrigerator for cooling the coil portion thermal shield cools the coil portion thermal shield 8*a* by a first-stage heat stage 51*a* and cools the coil portion second thermal shield 17*a* by the second-stage heat stage 52*a*. A compressor 13*a* causes a circulation at a predetermined pressure of helium gas serving as the working gas through the coil portion 2-stage type Gifford-McMahon cycle refrigerator 50*a*.

A helium reservoir portion 2-stage type Gifford-McMahon cycle refrigerator 50*b* serving as the regenerative refrigerator for cooling the refrigerant reservoir portion thermal shield cools the helium reservoir portion thermal shield 8*b* by a first-stage heat stage 51*b* and cools the helium reservoir portion second thermal shield 17*b* by a second-stage heat stage 52*b*. A compressor 13*b* causes a circulation of helium gas serving as the working gas through the helium reservoir portion 2-stage type Gifford-McMahon cycle refrigerator 50*b* in a similar manner as the above compressor 13*a*.

A detachable/reattachable current lead movable portion 60*a* is mounted in a manner movable in an up and down direction, electrically contacting a current lead fixed portion 60*b* to supply a current to a superconducting coil 1. A permanent current switch 101 constituted by a superconductor wire is contained in the helium reservoir tank 2*b* in a manner immersed in liquid helium 3 to operate the mode of permanent current flowing through the superconducting coil 1.

A beam chamber 61 to which electrons are directed is disposed in a manner sandwiched by a pair of superconducting coils 1. Then, a beam chamber thermal shield 62 is disposed so as to enclose the beam chamber 61. Further, a beam portion second thermal shield 63 is disposed in a manner enclosing the beam chamber thermal shield 62. It should be noted that, though not shown, the beam chamber thermal shield 62 is thermally connected to the coil portion thermal shield 8*a* and the beam portion second thermal shield 63 is thermally connected to the coil portion second thermal shield 17*a*. Further, a magnetic shield 25 is provided on the outer peripheral of the vacuum tank 10 to prevent leakage of the magnetic field generated by the superconducting coil 1.

In the superconducting magnet according to Embodiment 1 constructed as described, the superconducting coil 1 is brought into its superconductive state when cooled to a very low temperature (for example to 4.2K) by liquid helium 3 within the coil portion helium tank 2*a*. In this state, the detachable/reattachable current lead movable portion 60*a* is lowered to bring it into an electric contact with the detachable/reattachable current lead fixed portion 60*b*. An excitation current is supplied from an external power supply (not shown) provided for the superconducting magnet to generate a predetermined magnetic field. Upon attainment of steady state, a current is caused to flow to the superconducting coil 1 through the permanent current switch 101 and the detachable/reattachable current lead movable portion 60*a* is moved upward to disconnect the electric contact with the detachable/reattachable current lead fixed portion 60*b*. The superconducting coil 1 is then brought into its permanent current mode where it is capable of generating a predetermined magnetic field while disconnected from external superconducting magnet power sources.

On the other hand, the interior of the beam chamber 61 is evacuated to a high degree of vacuum and electrons accelerated to high energy level are guided therethrough. The orbit of movement of the electrons is restricted by the magnetic field generated by the pair of superconducting coils 1 disposed in a manner sandwiching the beam chamber 61.

Here, the superconducting coils 1 are immersed in liquid helium 3 filling up the interior of the coil portion helium tank 2*a* and thus is retained at a very low temperature. The liquid helium 3 is supplied through the helium piping 5 from the helium reservoir tank 2*b* provided above the coil portion helium tank 2*a*.

Further, the portion between the vacuum tank 10 and the helium reservoir tank 2*b*, the coil portion helium tank 2*a* is evacuated, thereby heat penetration from the vacuum tank 10 into the helium reservoir tank 2*b* and the coil portion helium tank 2*a* due to convection is prevented. Heat penetration occurs in the manner of radiation and conduction.

Thus, the coil portion second thermal shield 17*a* is provided in such a manner as to enclose the coil portion helium tank 2*a* to reduce heat penetration due to radiation and conduction into the coil portion helium tank 2*a* and the helium reservoir tank 2*b*. Further, the coil portion thermal shield 8*a* is provided so as to enclose the coil portion second thermal shield 17*a*. Moreover, the helium reservoir portion second thermal shield 17*b* is provided so as to enclose the helium reservoir tank 2*b*, and the helium reservoir portion thermal shield 8*b* is provided so as to enclose the helium reservoir portion second thermal shield 17*b*. In other words, the coil portion thermal shield and the refrigerant reservoir portion thermal shied are constituted by double thermal shields, respectively.

In order to fix the coil portion helium tank 2*a* and the helium reservoir tank 2*b* in positions, supports 11 are provided between these and the vacuum tank 10. Thus, the heat penetration due to conduction occurs mainly through the supports 11. Especially, the coil portion helium tank 2*a* requires that the supports 11 be capable of bearing the weight of the superconducting coil 1 therein and the electromagnetic force generated by the superconducting coil 1. For this reason, a robust member having a certain thickness must be selected as the support 11. For this reason, heat penetration due to conduction from the support 11 is large.

In order to reduce the heat penetration as described above, the coil portion 2-stage type Gifford-McMahon cycle refrigerator 50*a* is provided. The coil portion 2-stage type Gifford-McMahon cycle refrigerator 50*a* is operated such that a high-pressure helium gas is supplied from the compressor 13*a* and a low-pressure helium gas is exhausted to the compressor 13*a*. The coil portion thermal shield 8*a* is cooled by the first-stage heat stage 51*a* and the coil portion second shield 17*a* is cooled by the second-stage heat stage 52*a*. As a result, the coil portion thermal shield 8*a* may be cooled to a temperature of the order of 80K, and the coil portion second thermal shield 17*a* may be cooled to a temperature of the order of 20K. Then, since the coil portion second thermal shield 17*a* may be cooled to a temperature of the order of 20K, heat penetration into the coil portion helium tank 2*a* is the heat penetration from the level of 20K. A larger reduction in heat penetration is possible comparing to the cooling by liquid nitrogen. Further, since the coil portion 2-stage type Gifford-McMahon cycle refrigerator 50*a* is disposed in the vicinity of the supports 11, heat penetration from the supports 11 may be efficiently prevented.

On the other hand, heat penetration from supports (not shown) occurs also at the helium reservoir tank 2*b*, though it is less intensive than that at the coil portion helium tank 2*a*. Further, although the coil portion helium tank 2*a* and the helium reservoir tank 2*b* are connected to each other through the helium piping 5, the thermal shield at this portion is disposed so as to cover the vicinity of the helium piping 5 to save space. For this reason, the heat conductive area is small and thermal conduction is not efficient between the coil portion thermal shield 8*a*, the coil portion second thermal shield 17*a* and the helium reservoir portion thermal shield 8*b*, the helium reservoir portion second thermal shield 17*b*. Further, in order to prevent an eddy current, materials having a high thermal conductivity are not used at the coil portion thermal shield 8*a*, the coil portion second thermal shield 17*a*, the helium reservoir portion thermal shield 8*b* and the helium reservoir portion second thermal shield 17*b*.

From the above, however large its refrigerating capacity is, the refrigerating capacity only of the coil portion 2-stage type Gifford-McMahon cycle refrigerator 50*a* is not adequate for, at the same time, cooling the helium reservoir portion thermal shield 8*b* and the helium reservoir portion second thermal shield 17*b*. Thus, the helium reservoir portion 2-stage type Gifford-McMahon cycle refrigerator 50*b* is provided in the vicinity of the helium reservoir tank 2*b* separately from the coil portion 2-stage type Gifford-McMahon cycle refrigerator 50*a*, as the regenerative refrigerator for cooling the refrigerant reservoir portion thermal shields. The helium reservoir portion 2-stage type Gifford-McMahon cycle refrigerator 50*b* is operated such that a high-pressure helium gas is supplied from the compressor 13*b* and a low-pressure helium gas is exhausted to the compressor 13*b*. Cooling is effected of the helium reservoir portion thermal shield 8*b* by the first-stage heat stage 51*b* and of the helium reservoir portion second thermal shield 17*b* by the second-stage heat stage 52*b* to temperatures of 80K and 20K, respectively. Thus, heat penetration into the helium reservoir tank 2*b* occurs from the level of 20K and such heat penetration may be reduced comparing to the cooling by liquid nitrogen.

To the contrary, even if its refrigerating capacity is sufficient, the helium reservoir portion 2-stage type Gifford-McMahon cycle refrigerator 50*b* alone is not capable of sufficiently cooling also the coil portion thermal shield 8*a* and the coil portion second thermal shield 17*a* because of the reasons described above. Thus, the coil portion 2-stage type Gifford-McMahon cycle refrigerator 50*a* and the helium reservoir portion 2-stage type Gifford-McMahon cycle refrigerator 50*b* may be used together to reduce heat penetration into the coil portion helium tank 2*a* and the helium reservoir tank 2*b* and to reduce the evaporating amount of liquid helium 3.

In this manner, according to Embodiment 1, the coil portion thermal shield and the refrigerant reservoir portion thermal shield are cooled by the coil portion 2-stage type Gifford-McMahon cycle refrigerator 50*a* and the helium reservoir portion 2-stage type Gifford-McMahon cycle refrigerator 50*b*, respectively. A small-size, light-weight synchrotron superconducting magnet may be achieved, in which cooling performance may thus be improved to reduce the evaporation of liquid helium 3, and, as a result, maintenance may be facilitated as an interval between the replenishments of liquid helium 3 is extended.

Further, double thermal shield is constituted respectively at the coil portion thermal shield by the coil portion thermal shield 8*a* and the coil portion second thermal shield 17*a* and at the refrigerant reservoir portion thermal shield by the helium reservoir portion thermal shield 8*b* and the helium reservoir portion thermal shield 17*b*. The coil portion thermal shield and the refrigerant reservoir portion thermal shield are cooled by the coil portion 2-stage type Gifford-McMahon cycle refrigerator 50*a* and the helium reservoir portion 2-stage type Gifford-McMahon cycle refrigerator 50*b*, respectively. Therefore, the cooling performance may be improved furthermore to additionally reduce the evaporating amount of liquid helium 3.

Embodiment 2

Figure 2:
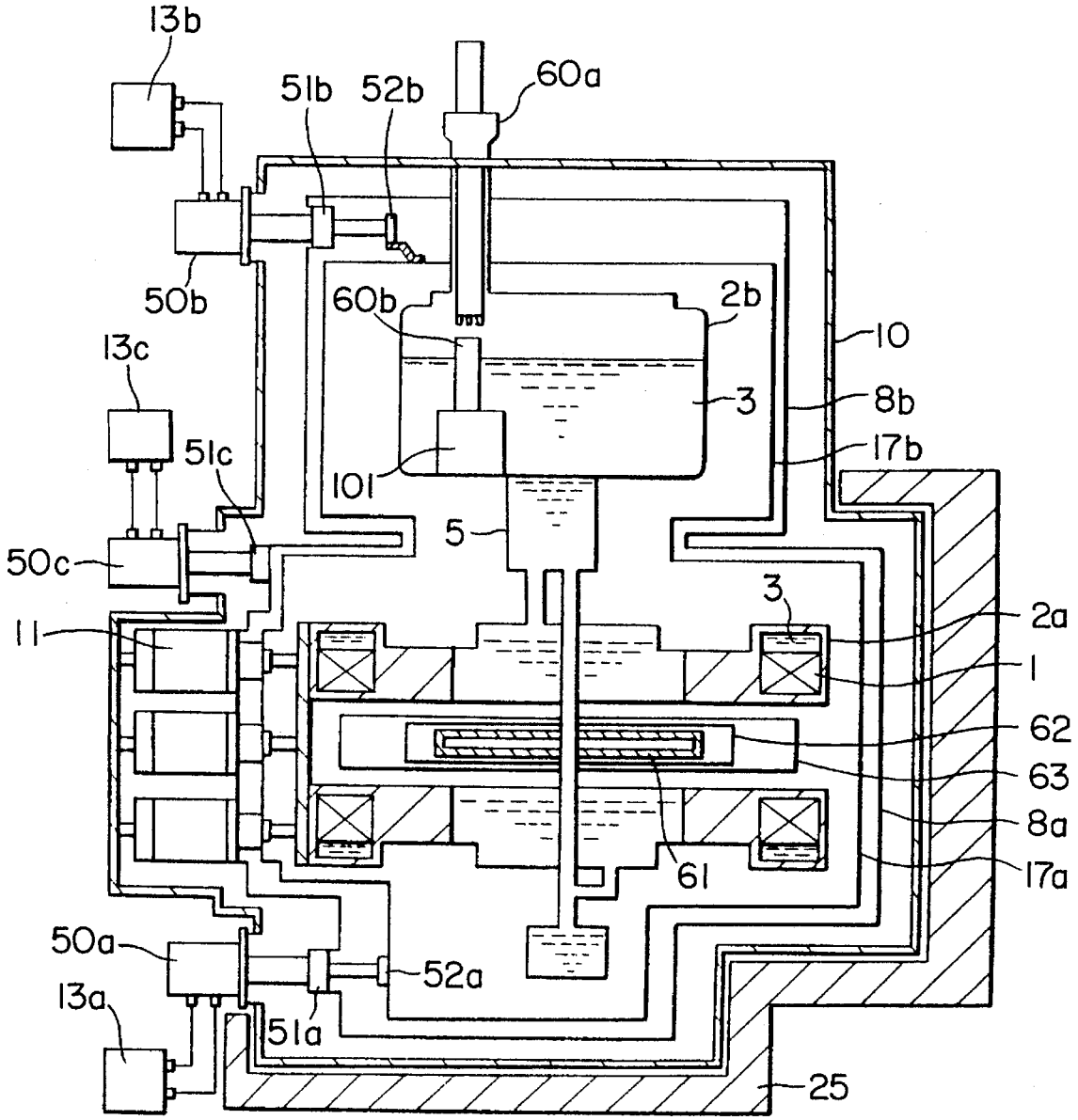
FIG. 2 is a sectional view showing a superconducting magnet according to Embodiment 2 of the present invention.

In Embodiment 2, the present invention is applied to a superconducting magnet for a synchrotron radiation apparatus. In embodiment 2, as shown in FIG. 2, a coil portion single stage type Gifford-McMahon cycle refrigerator 50*c* is additionally provided as a regenerative refrigerator for cooling the coil portion thermal shield in the superconducting magnet according to the above Embodiment 1. The coil portion single stage type Gifford-McMahon cycle refrigerator 50*c* is connected to a compressor 13*c* for supplying at a high pressure helium gas serving as the working gas and is disposed so as to cool the coil portion thermal shield 8*a* in the vicinity of the supports 11 by a first-stage heat stage 51*c* thereof.

In this manner, according to Embodiment 2, since the coil portion single stage type Gifford-McMahon cycle refrigerator 50*c* is additionally provided in the superconducting magnet according to the above Embodiment 1, cooling temperature at the portion of the support 11 connecting through the coil portion thermal shield 8*a* may be lowered. Heat penetration due to conduction from the support 11 for supporting the weight of the superconducting coil 1 contained in the coil portion helium tank 2*a* and the electromagnetic force generated by the superconducting coil 1 may be controlled to furthermore reduce the evaporating amount of liquid helium 3 in the coil portion helium tank 2*a*.

Embodiment 3

Figure 3:
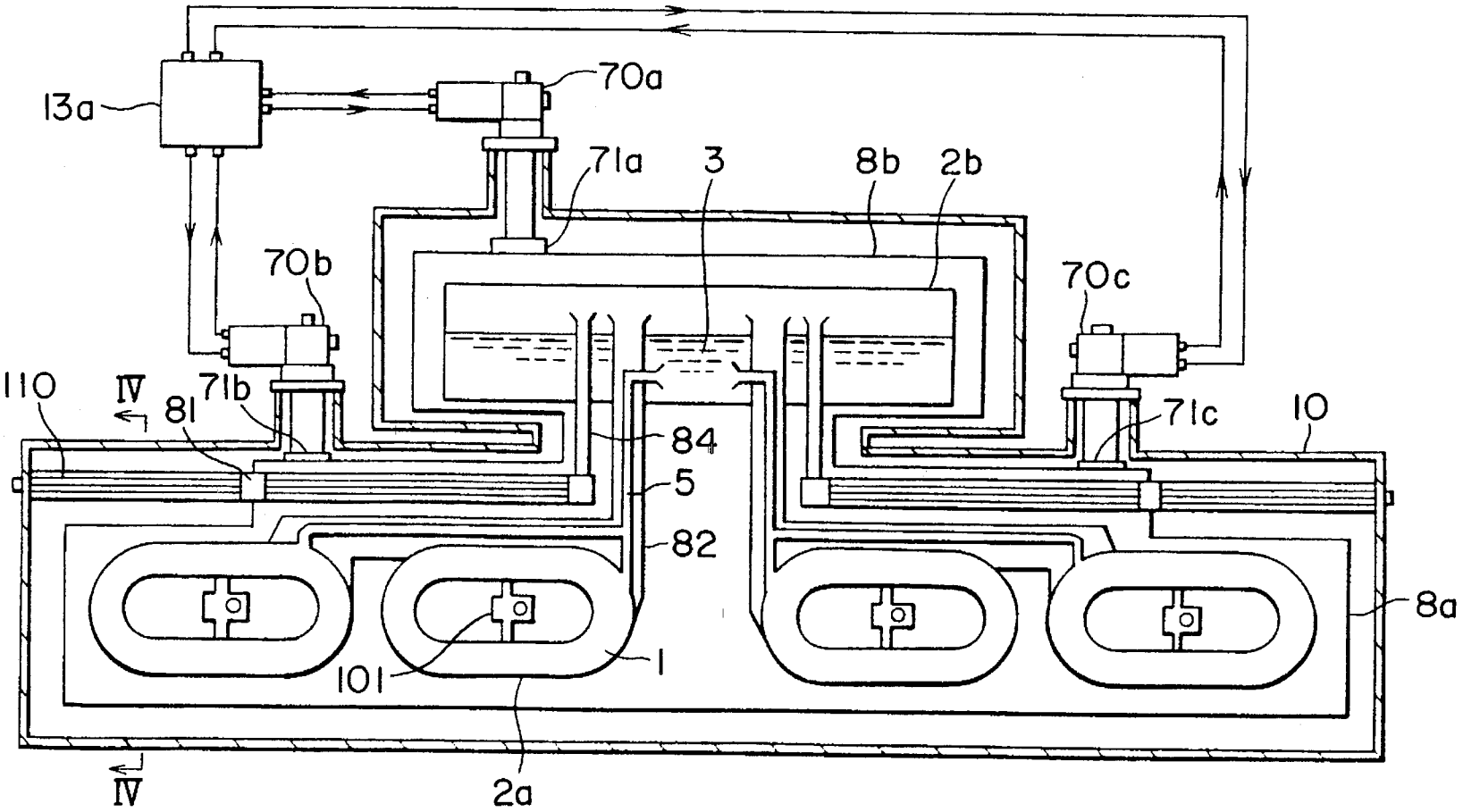
FIG. 3 is a sectional view showing a superconducting magnet according to Embodiment 3 of the present invention.
Figure 4:
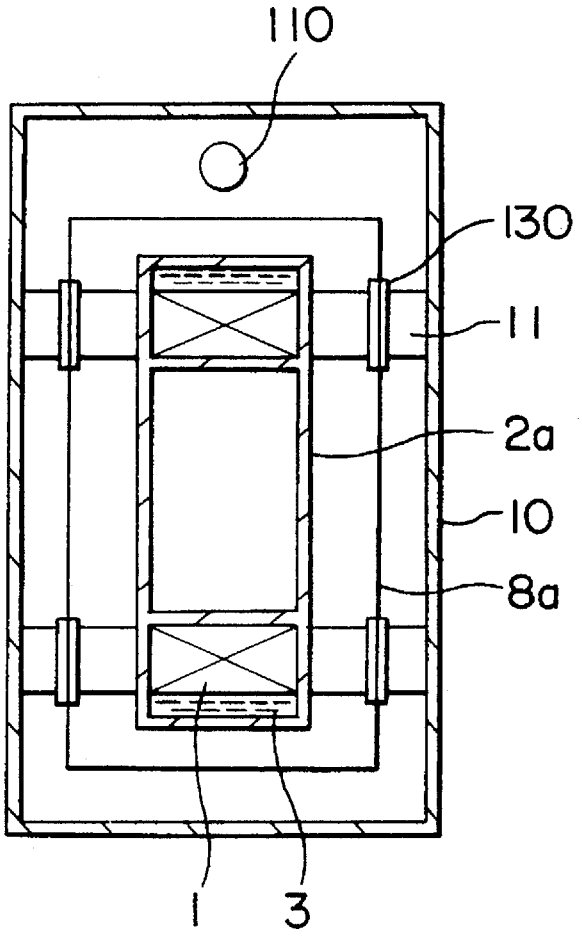
FIG. 4 is a sectional view taken along line IV—IV of FIG. 3.

In Embodiment 3, the present invention is applied to a superconducting magnet for a magnetic levitated ground transportation system. FIG. 3 is a sectional view showing the superconducting magnet according to Embodiment 3 of the present invention, and FIG. 4 is a sectional view taken along line IV—IV of FIG. 3. In Embodiment 3, a helium reservoir portion single stage type Gifford-McMahon cycle refrigerator 70*a* is provided as a regenerative refrigerator for cooling the helium reservoir portion thermal shield 8*b*. Further, a coil portion first single-stage type Gifford-McMahon cycle refrigerator 70*b* and a coil portion second single-stage type Gifford-McMahon cycle refrigerator 70*c* are provided as regenerative refrigerators for cooling the coil portion thermal shield to cool a coil portion thermal shield 8*a*. One compressor 13*a* for supplying helium gas serving as the working gas is connected to the helium reservoir portion single stage type Gifford-McMahon cycle refrigerator 70*a* and to the coil portion first single stage type and coil portion second single stage type Gifford-McMahon cycle refrigerators 70*b*, 70*c*. The portion between an intermediate part of supports 11 and the first-stage heat stages 71*b*, 71*c* of the coil portion first single stage type and coil portion second single stage type Gifford-McMahon cycle refrigerators 70*b*, 70*c* is connected by a heat conduction member 130 which is constituted by a material having a high thermal conductivity such as aluminum or copper. The middle portion of a current lead 110 for supplying an excitation current to the superconducting coil 1 is thermally connected to the coil portion thermal shield 8*a* by a thermal anchor 81. A recovery piping 82 is provided so as to be opened at one end thereof to the vapor-phase portion at the upper portion in a helium reservoir tank 2*b*, thereby recovering the evaporated gas of liquid helium 3 within the coil portion helium tank 2*a*. Further, a current lead cooling piping 84 is provided to cool the current lead 110.

In this manner, according to Embodiment 3, the thermal shield is cooled by a plurality of refrigerators. In particular, the helium reservoir portion thermal shield 8*b* is cooled by the helium reservoir portion single stage type Gifford-McMahon cycle refrigerator 70*a*, and the coil portion thermal shield 8*a* is cooled by the coil portion first single stage type Gifford-McMahon cycle refrigerator 70*b* and the coil portion second single stage type Gifford-McMahon cycle refrigerator 70*c*. The thermal shields are uniformly cooled as the thermal loads at the respective thermal shield portions are correspondingly borne by the respective refrigerators 70*a*, 70*b*, 70*c*. The heat penetration due to radiation into the helium reservoir tank 2*b* and the coil portion helium tank 2*a* may be reduced whereby the evaporating amount of liquid helium 3 is reduced. Further, the plurality of supports 11 and the current lead 110 for directly connecting the portion at room temperature and the helium tank may be securely cooled through the heat conductive member 130, the thermal anchor 81, the helium reservoir portion thermal shield 8*b* and the coil portion thermal shield 8*a* in a manner directly connected to the first-stage heat stages 71*a*, 71*b*, 71*c* of the respective refrigerators 70*a*, 70*b*, 70*c* as described above. Thus, the heat penetration due to heat conduction into the helium reservoir tank 2*b* and the coil portion helium tank 2*a* may be reduced.

Embodiment 4

Figure 5:
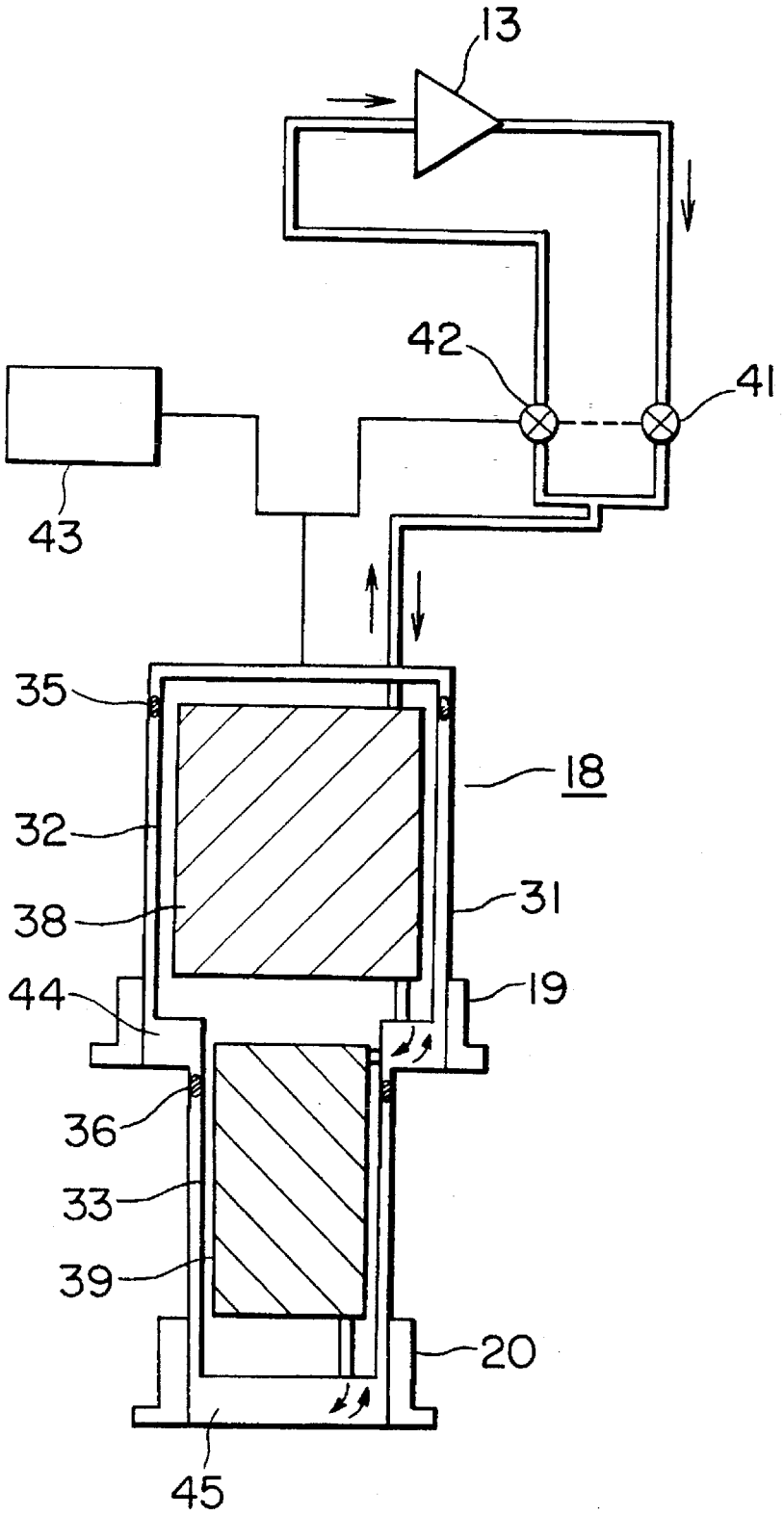
FIG. 5 is a diagrammatic sectional view showing a regenerative refrigerator according to Embodiment 4 of the present invention.
Figure 28:
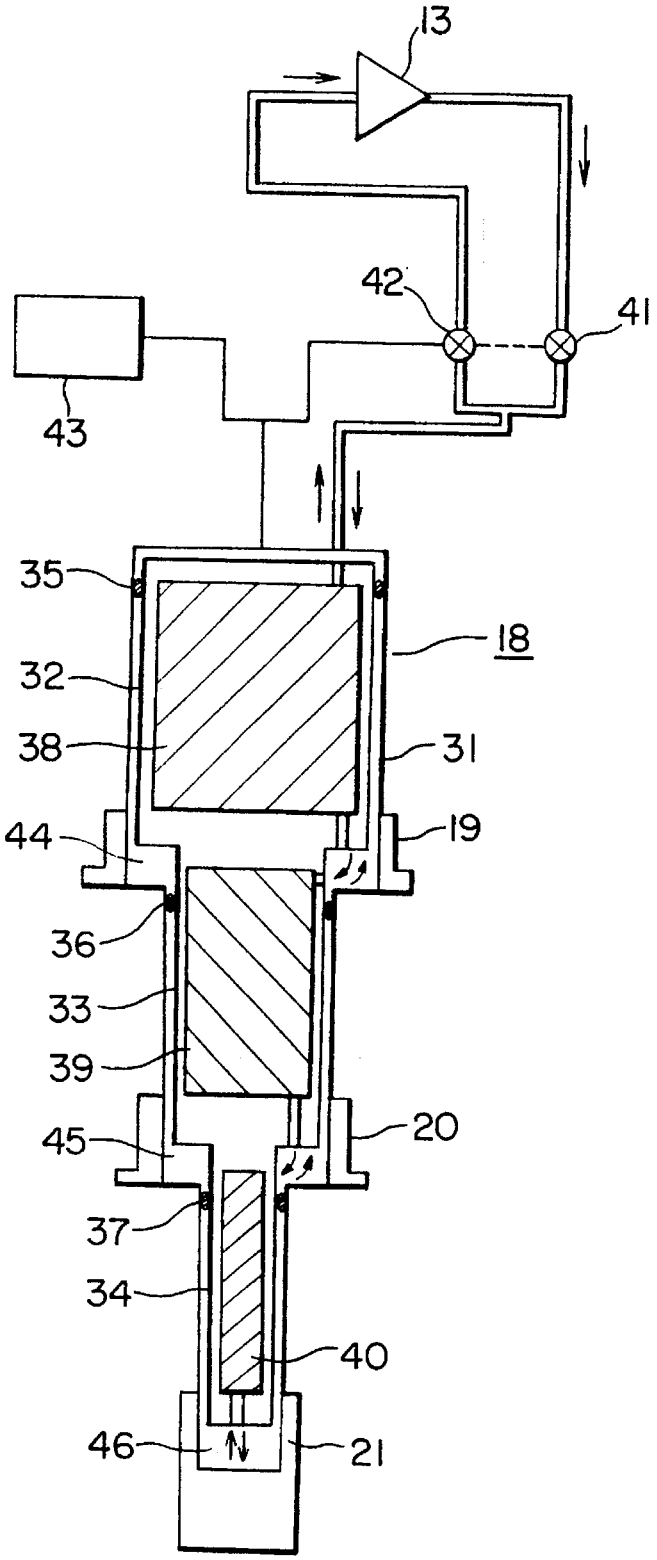
FIG. 28 PRIOR ART
FIG. 28 is a diagrammatic sectional view showing an example of regenerative refrigerator in a conventional superconducting magnet.

FIG. 5 is a sectional view showing a 2-stage type Gifford-McMahon cycle refrigerator according to Embodiment 4 of the present invention. In this figure, identical or corresponding portions as the conventional Gifford-McMahon cycle refrigerator shown in FIG. 28 are denoted by identical reference numerals and description thereof will be omitted.

In this figure, a first-stage regenerator 38 of the 2-stage type Gifford-McMahon cycle refrigerator is constituted for example such that the high-temperature side thereof is filled with copper mesh and the low-temperature side thereof is filled with lead balls. Further, a second-stage regenerator 39 is filled with a regenerative material for example having a composition such as Ho-Er-Ru, Er-Ni, GdRh, Er-Ni-Co, or Ey-Yb-Ni.

The 2-stage type Gifford-McMahon refrigerator constructed as described operates as follows.

First, in the state where first-stage and second-stage displacers 32, 33 are located at the lowermost end and a suction valve 41 is opened while an exhaust valve 42 is closed, the interior of first-stage and second-stage expansion spaces 44, 45 is in a high-pressure state as a high-pressure helium gas compressed at the compressor 13 is introduced.

Next, the first-stage and second-stage displacers 32, 33 are moved upward and, accordingly, the high-pressure helium gas is introduced into the first-stage and second-stage expansion spaces 44, 45. During this period, the suction and exhaust valves 41, 42 do not move. The high-pressure helium gas is cooled to a predetermined temperature by the respective regenerative materials when it passes through the first-stage and second-stage regenerators 38, 39.

Then, the first-stage and second-stage displacers 32, 33 are at the uppermost end, the suction valve 41 is closed and the exhaust valve 42 is opened whereby the high-pressure helium gas is expanded to a low-pressure gas to cause refrigeration. At this time, the helium gas existing in the first-stage and second-stage expansion spaces 44, 45 is brought to its low-temperature and low-pressure state.

Next, by the downward movement of the first-stage and second-stage displacers 32, 33, the low-temperature and low-pressure helium gas passes through the first-stage and second-stage regenerators 38, 39 and is exhausted from the exhaust valve 42. At this time, after cooling the regenerative materials in the first-stage and second-stage regenerators 38, 39, the low-temperature and low-pressure helium gas is returned to the compressor 13. Thereafter, in the state where the volume of the first-stage and second-stage expansion spaces 44, 45 is at minimum, the exhaust valve 42 is closed and the suction valve 41 is opened to introduce a high-pressure helium gas compressed at the compressor 13, whereby the pressure of the first-stage and second-stage expansion spaces 44, 45 change from a low pressure to a high pressure. The above process constitutes one cycle of the operation of the 2-stage type Gifford-McMahon cycle refrigerator.

Here, refrigeration amount of the 2-stage type Gifford-McMahon cycle refrigerator is expressed by the following formula.

$$Q_1=\int_{v1}P_1dV$$

$$Q_2=\int_{v2}P_2dV$$

where:

$Q_1$ is refrigeration amount at the first stage;

$P_1$ is pressure in the first-stage expansion space;

$V_1$ is volume of the first-stage expansion space $Q_2$ is refrigeration amount at the second stage;

$P_2$ is pressure in the second-stage expansion space; and $V_2$ is volume of the second-stage expansion space.

To increase the refrigerating capacity for liquefying a cryogenic refrigerant gas, it suffices to increase the size of refrigerator, i.e., to increase $V_1$, $V_2$. However, since processing flow of the refrigerator is increased if $V_1$ and $V_2$ are larger, a compressor 13 with a larger throughput is required and power of motor 43 must be increased. Accordingly, even though the capacity for liquefying the cryogenic refrigerant gas is increased, the efficiency thereof is decreased. Thus, if it is desired to increase the liquefying capacity of the cryogenic refrigerant gas by using the conventional compressor and motor 43 while fixing $V_1+V_2$, it is seen from the above formula that this can be done by decreasing $V_1$ while increasing $V_2$. Then, from the above formulas, the refrigerating capacity of the first-stage heat stage 19 is decreased and the temperature of the first-stage heat stage 19 is increased. Accordingly, heat penetration into the second-stage heat stage 20 is increased, and, after all, the refrigerating capacity of the second-stage heat stage 20 is decreased, i.e., decreasing the capacity for liquefying the cryogenic refrigerant gas.

Therefore, an optimal range exists for volume ratio of the first-stage expansion space 44 to the second-stage expansion space 45 ($V_1/V_2$).

Figure 6:
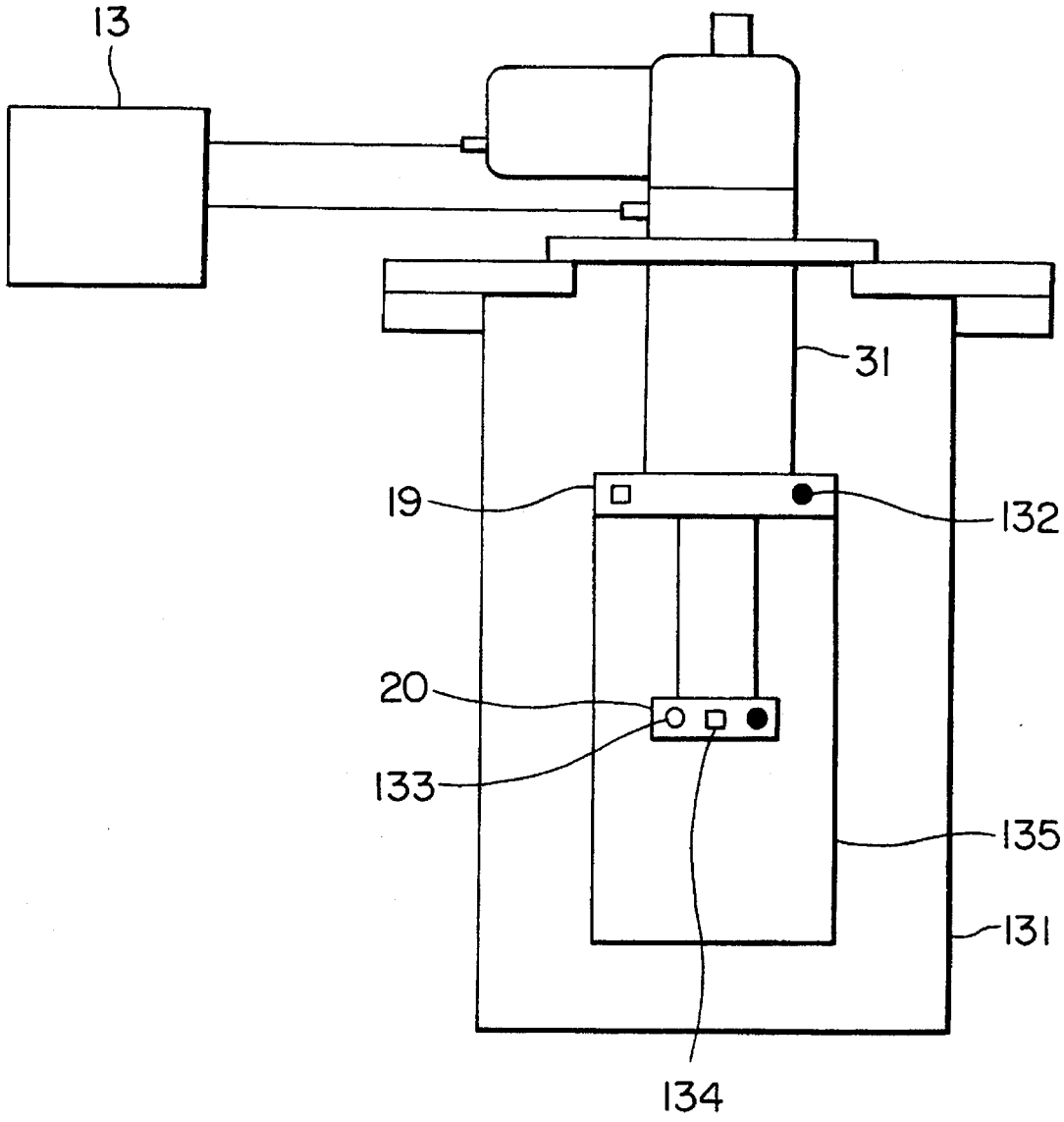
FIG. 6 is a sectional view showing an experimental apparatus of regenerative refrigerator according to Embodiment 4 of the present invention.

To investigate such optimal range, experiments were conducted by means of experimental apparatus as shown in FIG. 6. In this experimental apparatus, a cylinder 31 was disposed within a vacuum container 131, and the temperature of the first-stage heat stage 19 was measured at a Pt—Co temperature sensor 132 while the temperature of the second-stage heat stage 20 was measured at a Ge temperature sensor 133. A cartridge heater 134 was attached to the second-stage heat stage 20 and temperature of each stage when loaded with the cartridge 134 was measured. The heater load amount at this time corresponds to the refrigeration amount of the refrigerator. A radiation shielding plate 135 is disposed at the first-stage heat stage 19 to prevent radiation from a room temperature to the second-stage heat stage 20 so as to improve the accuracy in measurement. Then, in this experimental apparatus, diameter of the first-stage expansion space is fixed and diameter of the second-stage heat stage is to be increased.

Figure 7:
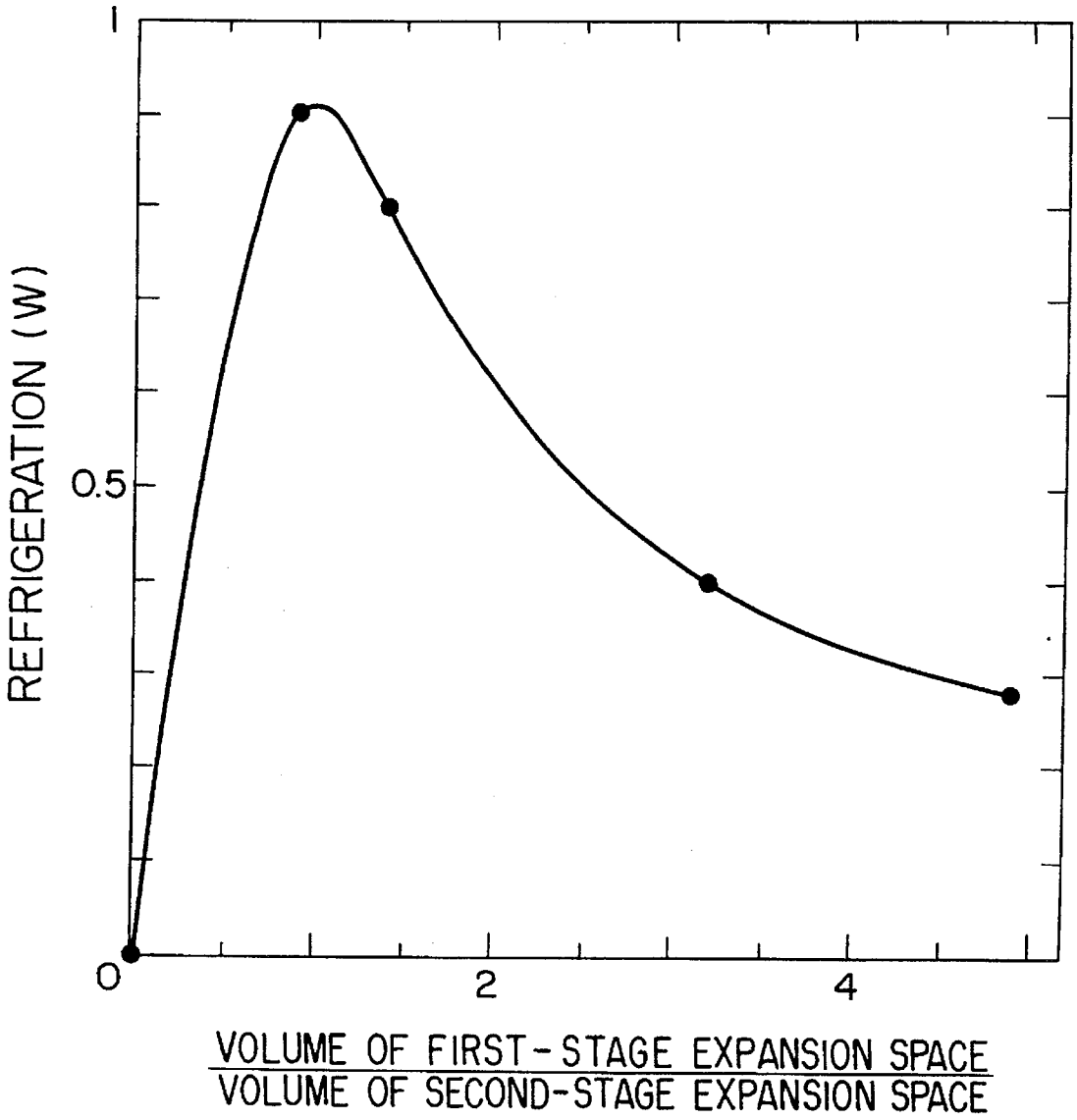
FIG. 7 is a graph showing the relation between volume ratio of the first-stage expansion space to the second-stage expansion space and the amount of refrigeration.

Results of measurements by the above experimental apparatus are shown in FIG. 7. In FIG. 7, ratio of volume of the first-stage expansion space to volume of the second-stage expansion space ($V_1/V_2$) is represented on the horizontal axis and the refrigerating capacity of the second-stage heat stage at a condensation temperature of 4.2K is represented on the vertical axis. It is seen from these experimental results that the maximum refrigerating capacity is 0.9 W and a refrigerating capacity of 0.45 W or more is obtained if the ratio of volume of the first-stage expansion space to volume of the second-stage expansion space ($V_1/V_2$) is within the range of 0.45 to 2.8. Further, since the same compressor 13 and the same driving motor 43 are used in the experiment of FIG. 7, the required electrical input is substantially fixed.

Thus, the refrigerating capacity for liquefying helium gas may be improved and, at the same time, the efficiency thereof may be improved by setting the ratio of volume of the first-stage expansion space to volume of the second-stage expansion space ($V_1/V_2$) of a 2-stage type Gifford-McMahon cycle refrigerator to be in the range of 0.45 to 2.8.

Embodiment 5

Figure 8:
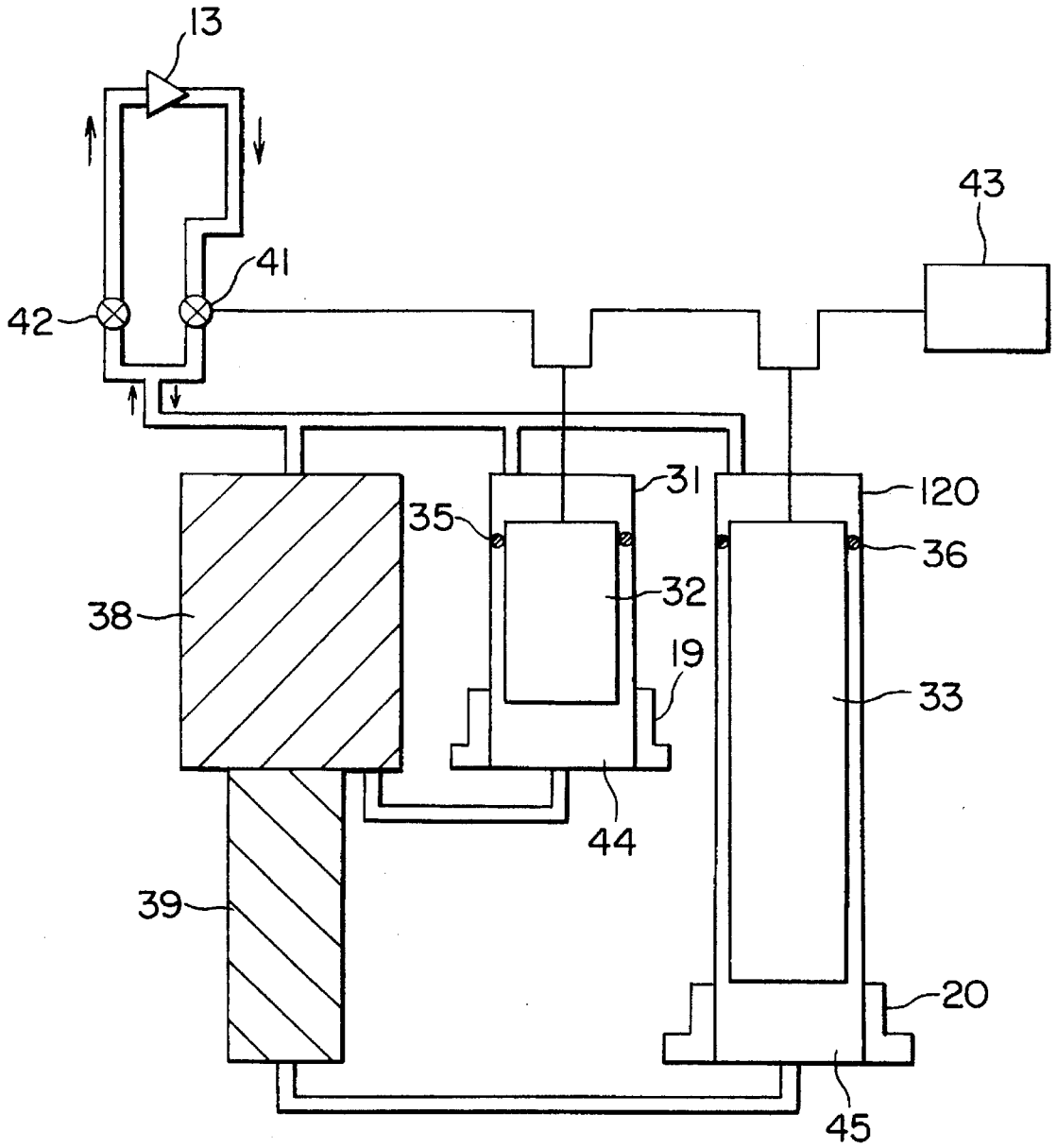
FIG. 8 is a diagrammatic sectional view showing regenerative refrigerator according to Embodiment 5 of the present invention.

FIG. 8 is a sectional view showing a 2-stage type Gifford-McMahon cycle refrigerator according to Embodiment 5 of the present invention.

In the above Embodiment 4, the first-stage regenerator 38 and the second-stage regenerator 39 are integrated to the interior of the first-stage and second-stage displacers 32 and 33, respectively. In Embodiment 5, however, the first-stage regenerator 38 and the second-stage regenerator 39 are placed apart from the first-stage and second-stage displacers 32 and 33. A first-stage cylinder 31 and a second-stage cylinder 120 are provided independently from each other. Connection through a communication piping is provided between the first-stage regenerator 38 and the first-stage cylinder 31 and between the second-stage regenerator 39 and the second-stage cylinder 120. In this case, while the first-stage regenerator 38 and the second-stage regenerator 39 are stationary, operation of cycle is similar to that of the 2-stage type Gifford-McMahon cycle refrigerator of the above Embodiment 4, and the refrigerating capacity, too, is substantially identical for the same dimensions.

Embodiment 6

In Embodiment 6, the present invention is applied to superconducting magnet for synchrotron radiation apparatus.

Figure 9:
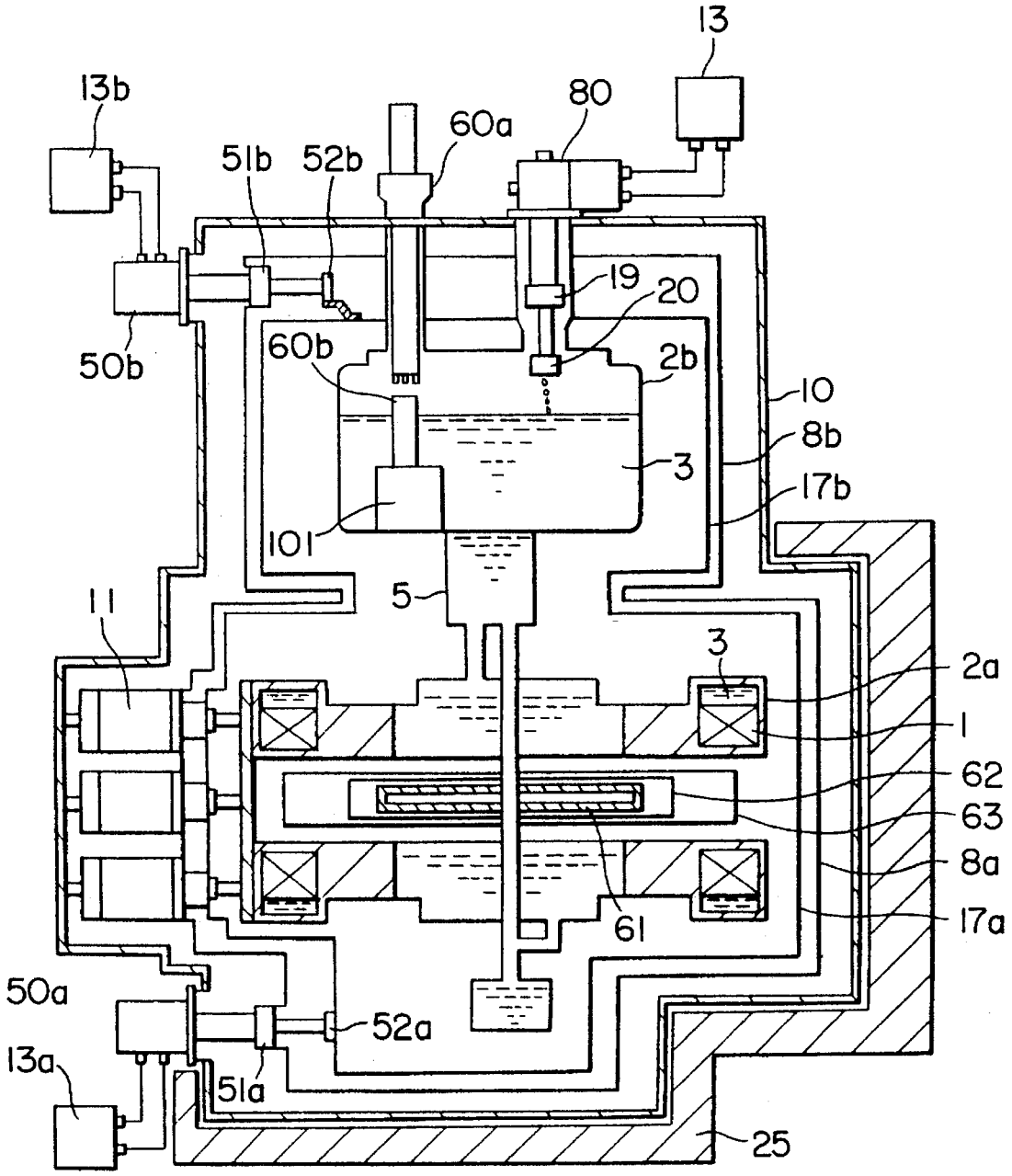
FIG. 9 is a sectional view showing a superconducting magnet according to Embodiment 6 of the present invention.

FIG. 9 is a sectional view showing a superconducting magnet according to Embodiment 6 of the present invention. In this figure, a 2-stage type Gifford-McMahon cycle refrigerator 80 for liquefying helium gas serving as a regenerative refrigerator for cooling a cryogenic refrigerant tank is provided so as to expose its second-stage heat stage 20 to the vapor-phase portion of the helium reservoir tank 2*b*. It should be noted that Embodiment 6 is constructed similarly to Embodiment 1 as described except that the 2-stage type Gifford-McMahon cycle refrigerator 80 is provided.

In particular, in Embodiment 6, the cryogenic refrigerant tank is constituted by a coil portion helium tank 2*a* and a helium reservoir tank 2*b*. The thermal shield is constituted by a coil portion thermal shield 8*a*, a coil portion second thermal shield 17*a*, a helium reservoir portion thermal shield 8*b* and a helium reservoir portion second thermal shield 17*b*. Thus, the coil portion thermal shield 8*a* and the coil portion second thermal shield 17*a* are cooled by first-stage and second-stage heat stages 51*a*, 52*a* of the 2-stage type Gifford-McMahon cycle refrigerator 50*a*. The helium reservoir portion thermal shield 8*b* and the helium reservoir portion second thermal shield 17*b* are cooled by first-stage and second-stage heat stages 51*b*, 52*b* of the helium reservoir portion 2-stage type Gifford-McMahon cycle refrigerator 50*b*. Further, the helium gas evaporated in the helium reservoir tank 2*b* is directly liquefied by the second-stage heat stage 20 of the helium liquefying 2-stage type Gifford-McMahon cycle refrigerator 80.

Figure 10:
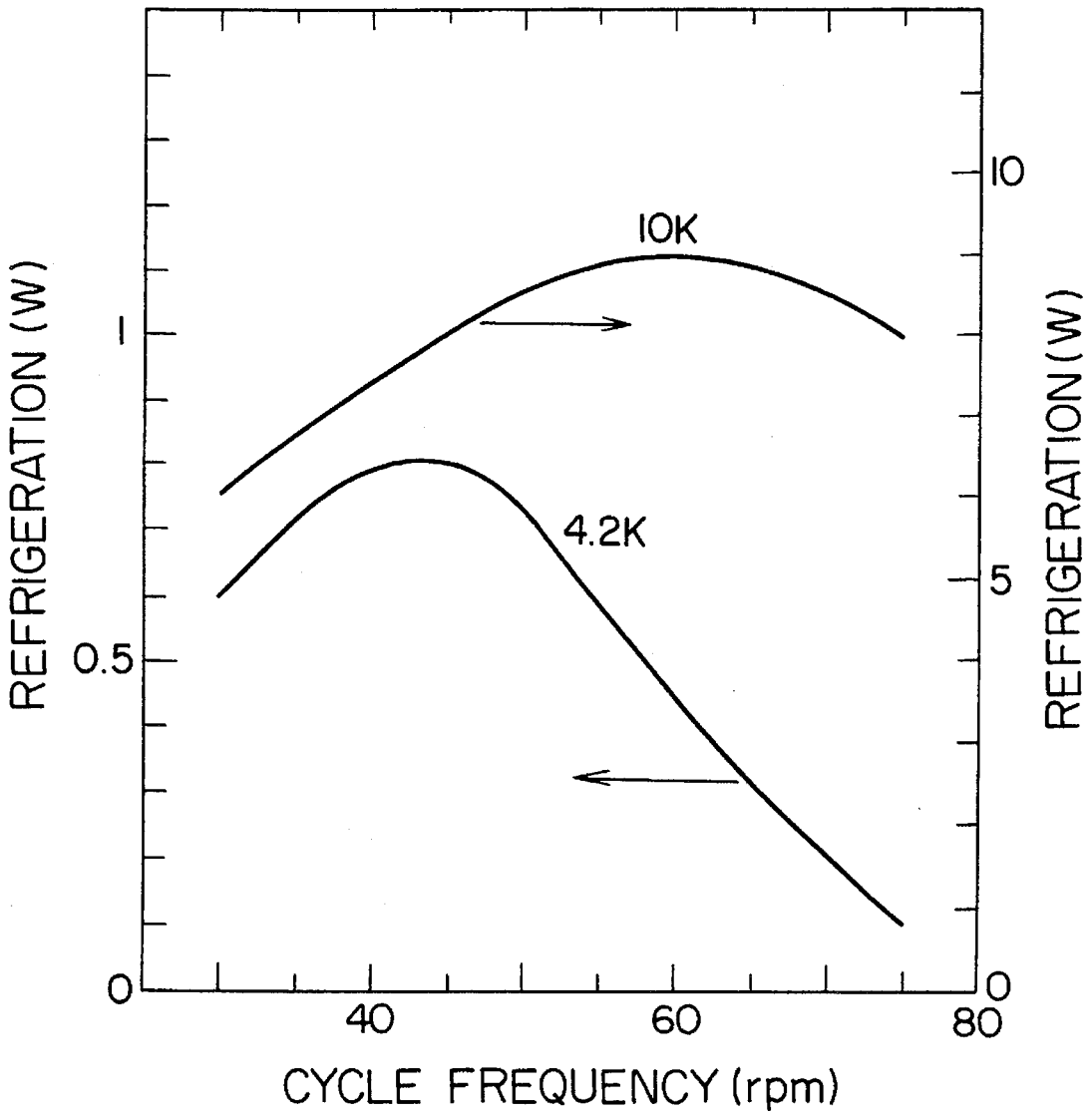
FIG. 10 is a graph showing the relation between cycle frequencies and refrigeration amount of a regenerative refrigerator in the superconducting magnet according to Embodiment 6 of the present invention.

Here, the refrigerating capacity of the helium liquefying 2-stage type Gifford-McMahon cycle refrigerator 80 at helium condensation temperature (4.2K) having a volume ratio of the first-stage expansion space to the second-stage expansion space of 1.4 is 0.8 W when the cycle frequency is 45 rpm. This refrigerating capacity depends on the cycle frequency. FIG. 10 shows the effect of cycle frequency on the refrigeration where the experimental apparatus as shown in FIG. 6 is used and cycle frequency of the driving motor 43 is varied. From FIG. 10, when the temperature is 4.2K, the optimal cycle frequency is 45 rpm and the refrigeration amount at that time is 0.8 W. In the case of 10K on the other hand, the optimal cycle frequency is 60 rpm. If it is operated at 60 rpm when the temperature is 4.2K, the refrigeration amount is 0.35 W and only the refrigeration amount of the order of 40% of that at the optimal frequency may be obtained. In other words, the optimal frequency tends to be higher as the temperature increases. Thus, it can be seen that a better efficiency is obtained when a helium liquefying refrigerator and a thermal shield cooling refrigerator are separately provided.

In this manner, according to Embodiment 6, a regenerative refrigerator for cooling thermal shield and a regenerative refrigerator for liquefying helium gas are respectively provided. Thus, cycle frequencies of the Gifford-McMahon cycle refrigerators applied at the thermal shield portion and the helium liquefying portion that are different in refrigeration generating temperature are respectively optimized. Thereby, highly efficient operation is possible and the evaporating amount of liquid helium 3 is reduced. In some cases, evaporation does not occur. As a result, the superconducting magnet is reduced in size and weight and its cooling performance is improved to greatly reduce the evaporating amount of liquid helium 3. In addition, an interval between replenishments of liquid helium 3 may be greatly extended to facilitate its maintenance.

Embodiment 7

Figure 11:
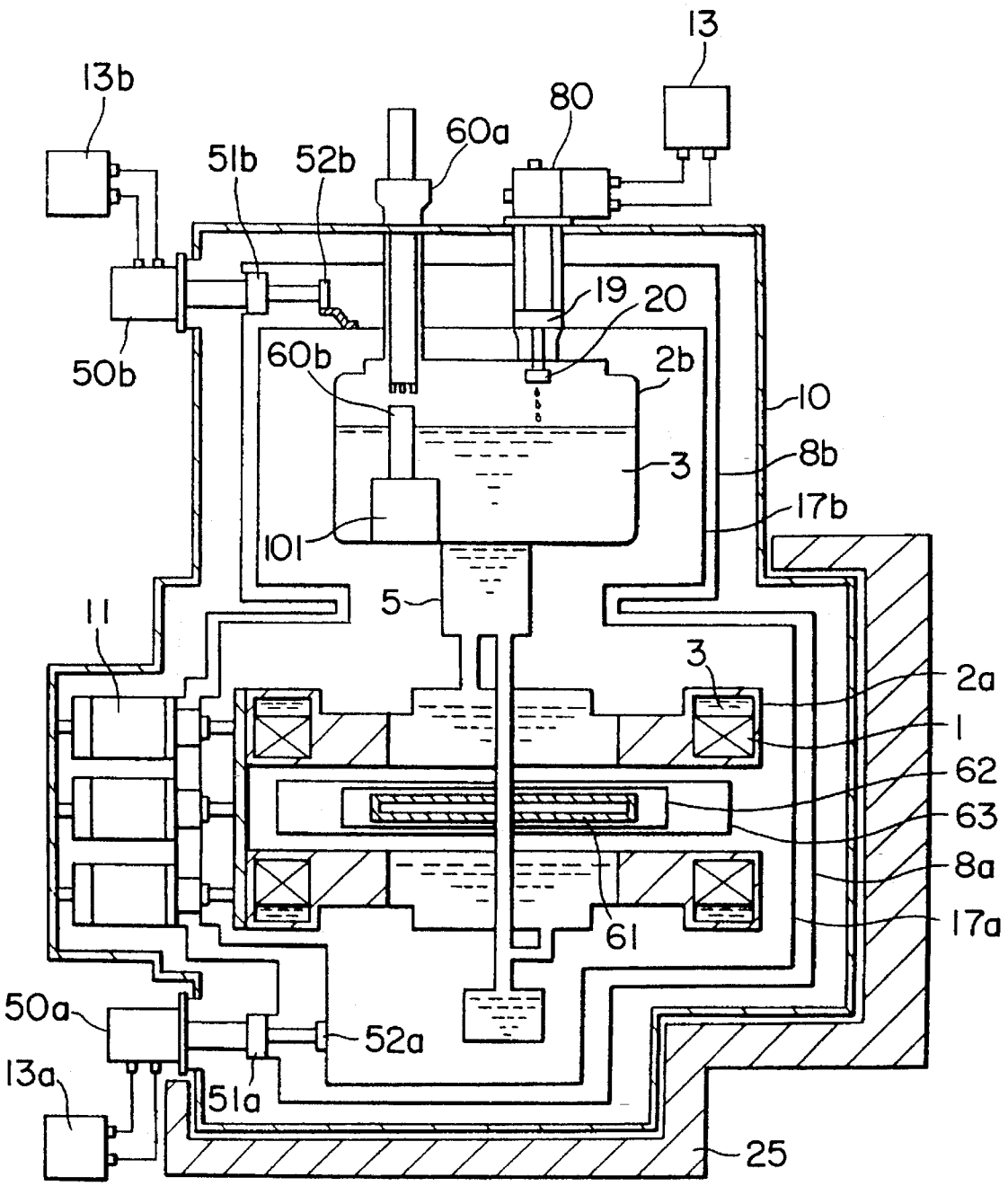
FIG. 11 is a sectional view showing a superconducting magnet according to Embodiment 7 of the present invention.
Figure 12:
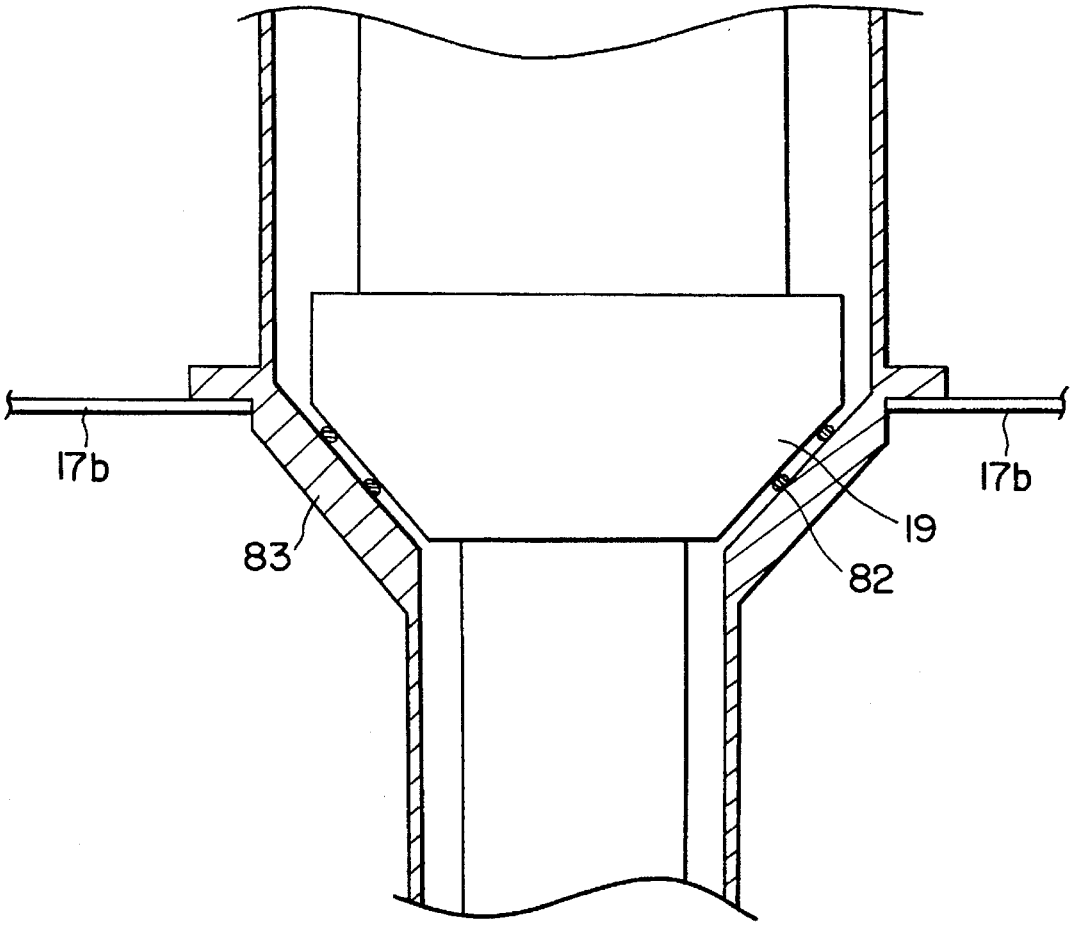
FIG. 12 is a partial sectional view in the vicinity of a first-stage heat stage of the regenerative refrigerator in the superconducting magnet according to Embodiment 7 of the present invention.

In Embodiment 7, the present invention is applied to a superconducting magnet of synchrotron radiation apparatus. FIG. 11 is a sectional view for showing a superconducting magnet according to Embodiment 7 of the present invention. FIG. 12 is a partial sectional view showing the vicinity of a first-stage heat stage 19 of a helium liquefying 2-stage type Gifford-McMahon refrigerator 80.

In the figures, a first-stage heat stage 19 of the helium liquefying 2-stage type Gifford-McMahon refrigerator 80 and a first-stage heat stage connecting portion 83 are tapered and a soft metal 182 such as indium is sandwiched between them. Here, Embodiment 7 is constructed similarly to the above Embodiment 6 except that the first-stage heat stage 19 of the helium liquefying 2-stage type Gifford-McMahon refrigerator 80 is utilized to cool the helium reservoir portion second thermal shield 17*b*.

According to Embodiment 7, since the first-stage heat stage 19 and the first-stage heat stage connecting portion 83 are tapered, the helium liquefying 2-stage type Gifford-McMahon refrigerator 80 may be inserted while being slid at the time of its mounting. Further, since the soft metal 182 such as indium is inserted between the first-stage heat stage 19 and the first-stage heat stage connecting portion 83, thermal connection between these two members is improved so that cooling of the helium reservoir portion second thermal shield 17*b* may be reinforced by the first-stage heat stage 19 through the first-stage heat stage connecting portion 83. Heat penetration into the helium reservoir tank 2*b* may be furthermore reduced.

Embodiment 8

Figure 13:
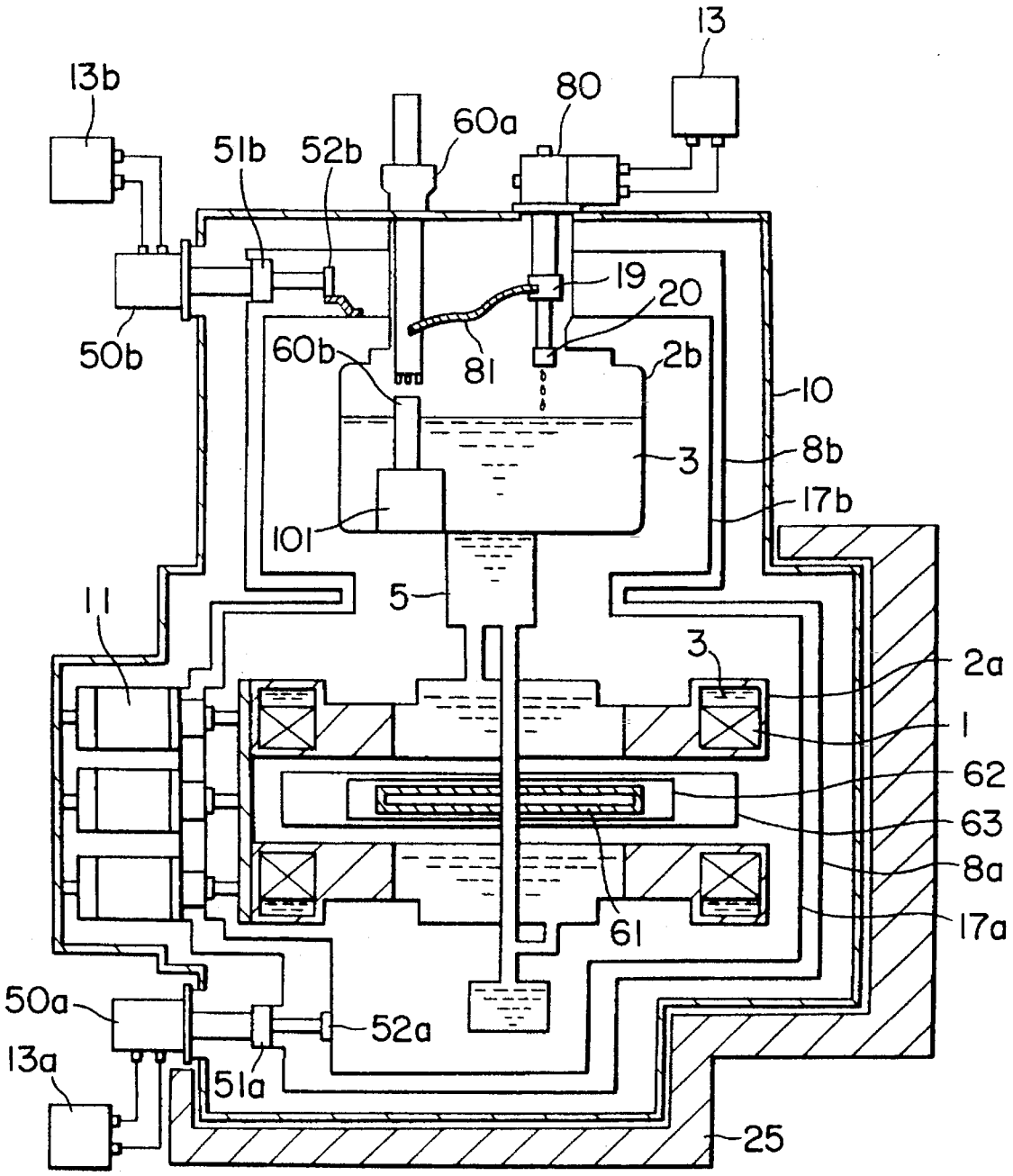
FIG. 13 is a sectional view showing a superconducting magnet according to Embodiment 8 of the present invention.

In Embodiment 8, the present invention is applied to a superconducting magnet for synchrotron radiation apparatus. FIG. 13 is a sectional view showing the superconducting magnet according to Embodiment 8 of the present invention. Embodiment 8 is constructed similarly to the above FIG. 6 except that a first-stage heat stage 19 of a helium liquefying 2-stage type Gifford-McMahon refrigerator 80 and a suitable intermediate portion detachable/reattachable current lead movable portion 60*a* are thermally connected by means of a current lead cooling member 181 for example formed from a flexible copper wire so that the detachable/reattachable current lead movable portion 60*a* may be cooled.

While the detachable/reattachable current lead movable portion 60*a* is cooled by evaporated helium gas, cooling of the detachable/reattachable current lead movable portion 60*a* is insufficient when evaporating amount of liquid helium 3 is decreased, whereby its temperature is higher to increase heat penetration into the helium reservoir tank 2*b*. According to Embodiment 8, the detachable/reattachable current lead movable portion 60*a* is cooled by the first-stage heat stage 19 of the helium liquefying 2-stage type Gifford-McMahon cycle refrigerator 80 through the current lead member 181 so that heat penetration into the helium reservoir tank 2*b* as a result of the temperature rise of the detachable/reattachable current lead movable portion 60*a* may be reduced.

Embodiment 9

Figure 14:
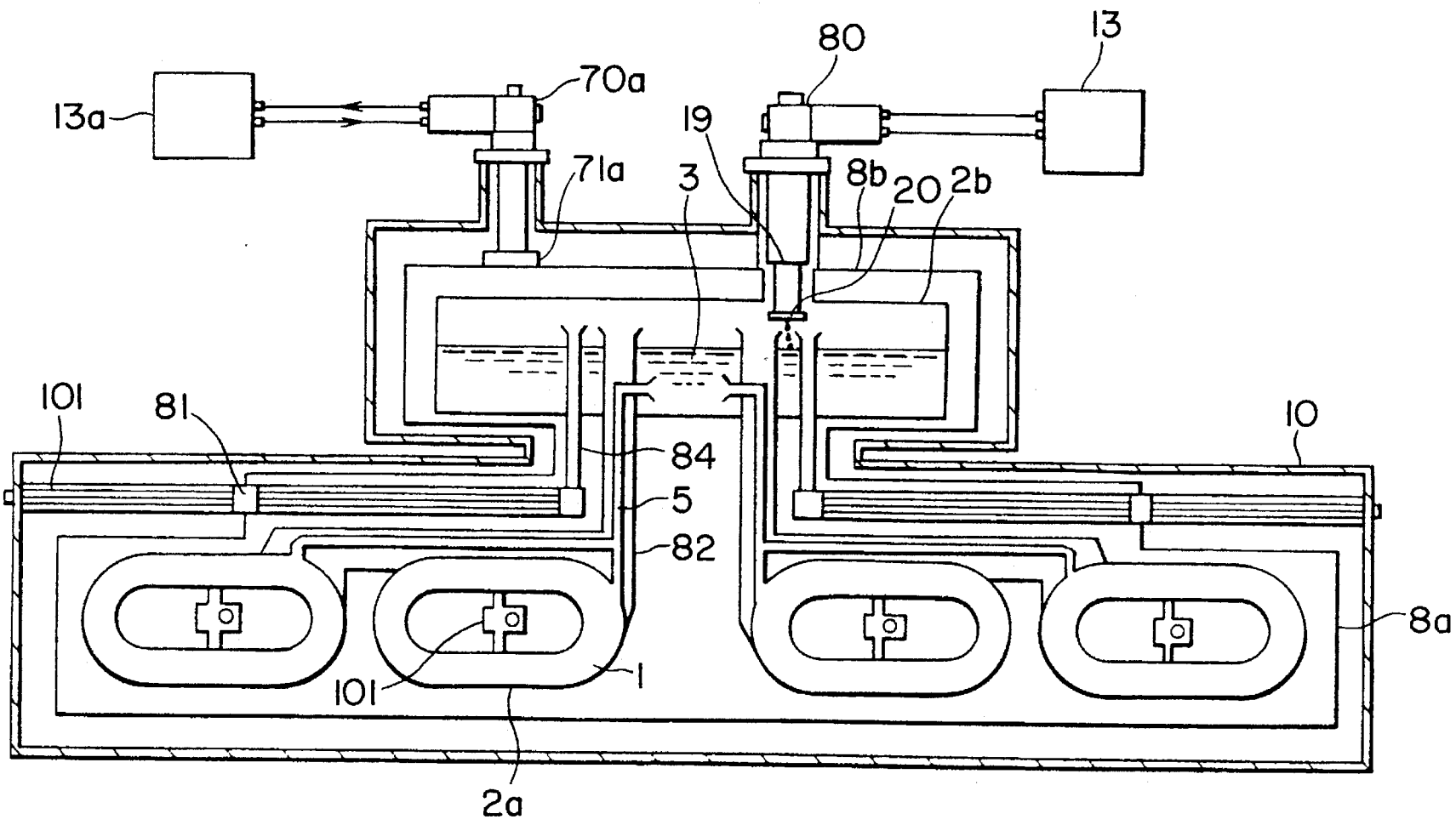
FIG. 14 is a sectional view showing a superconducting magnet according to Embodiment 9 of the present invention.

In Embodiment 9, the present invention is applied to a superconducting magnet of a magnetic levitated ground transportation system. FIG. 14 is a sectional view showing the superconducting magnet according to Embodiment 9 of the present invention. In Embodiment 9, a cryogenic refrigerant tank is constituted by a coil portion helium tank 2*a* and a helium reservoir tank 2*b*, and thermal shield is constituted by a coil portion thermal shield 8*a* and a helium reservoir portion thermal shield 8*b*. The helium reservoir portion thermal shield 8*b* is cooled by a first-stage heat stage 71*a* of a helium reservoir portion single stage type Gifford-McMahon cycle refrigerator 70*a*, and the evaporated helium gas within the helium reservoir tank 2b is liquefied by a second-stage heat stage 20 of a helium liquefying 2-stage type Gifford-McMahon cycle refrigerator 80.

In this manner, according to Embodiment 9, the helium reservoir portion thermal shield 8b may be cooled by the helium reservoir portion single stage type Gifford-McMahon cycle refrigerator 70a to prevent heat penetration into the helium reservoir tank 2b. Further, the helium gas evaporated in the helium reservoir tank 2b and the coil portion helium tank 2a is liquefied by a helium liquefying 2-stage type Gifford-McMahon cycle refrigerator 80 which is separate from the helium reservoir portion single stage type Gifford-McMahon cycle refrigerator 70a. Thus, the cycle frequencies of the respective refrigerators may be optimized to effect a highly efficient-operation. Cooling capacity is improved to reduce the evaporating amount of liquid helium 3 whereby an interval between replenishments of liquid helium 3 may be greatly extended to facilitate maintenance.

Embodiment 10

Figure 15:
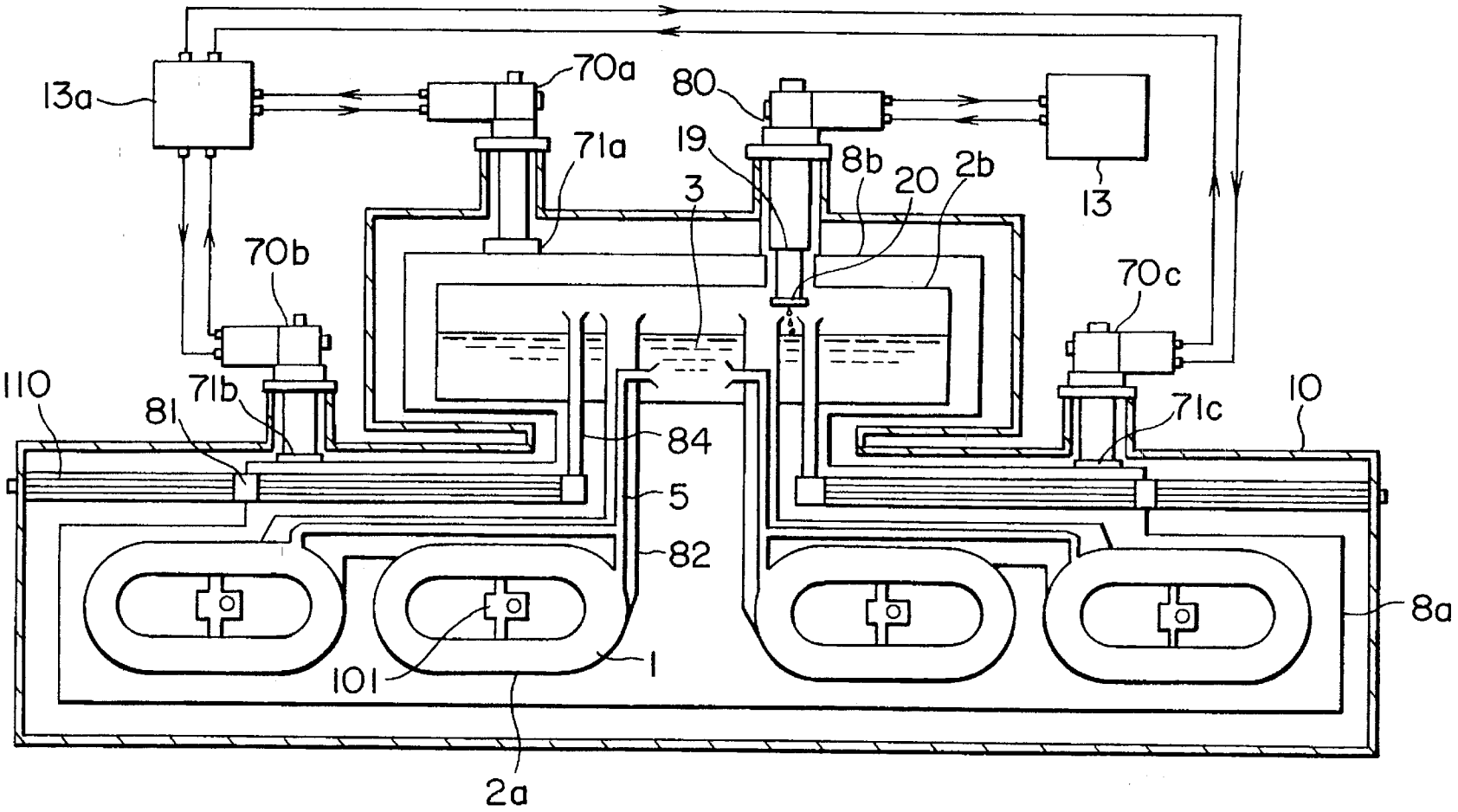
FIG. 15 is a sectional view showing a superconducting magnet according to Embodiment 10 of the present invention.

In Embodiment 10, the present invention is applied to a superconducting magnet of a magnetic levitated ground transportation system. FIG. 15 is a sectional view showing the superconducting magnet according to Embodiment 10of the present invention. Construction of Embodiment 10 is similar to the above described Embodiment 3 except that a helium liquefying 2-stage type Gifford-McMahon cycle refrigerator 80 is disposed so as to expose its second-stage heat stage 20 to the vapor-phase portion within the helium reservoir tank 2b.

According to Embodiment 10, the helium gas evaporated in the helium reservoir tank 2b and the coil portion helium tank 2a is liquefied by the helium liquefying 2-stage type Gifford-McMahon cycle refrigerator 80 which is separate from the helium reservoir portion single stage type Gifford-McMahon cycle refrigerator 70a and coil portion first and second single stage type Gifford-McMahon cycle refrigerators 70b, 70c for respectively cooling the helium reservoir portion thermal shield 8b and the coil portion thermal shield 8a. In addition to advantage of the above Embodiment 3, the cycle frequencies of the respective refrigerators may be optimized to effect a highly efficient operation. Cooling capacity is improved to reduce the evaporating amount of the liquid helium 3 whereby an interval between replenishments of liquid helium 3 may be greatly extended to facilitate maintenance.

Embodiment 11

Figure 16:
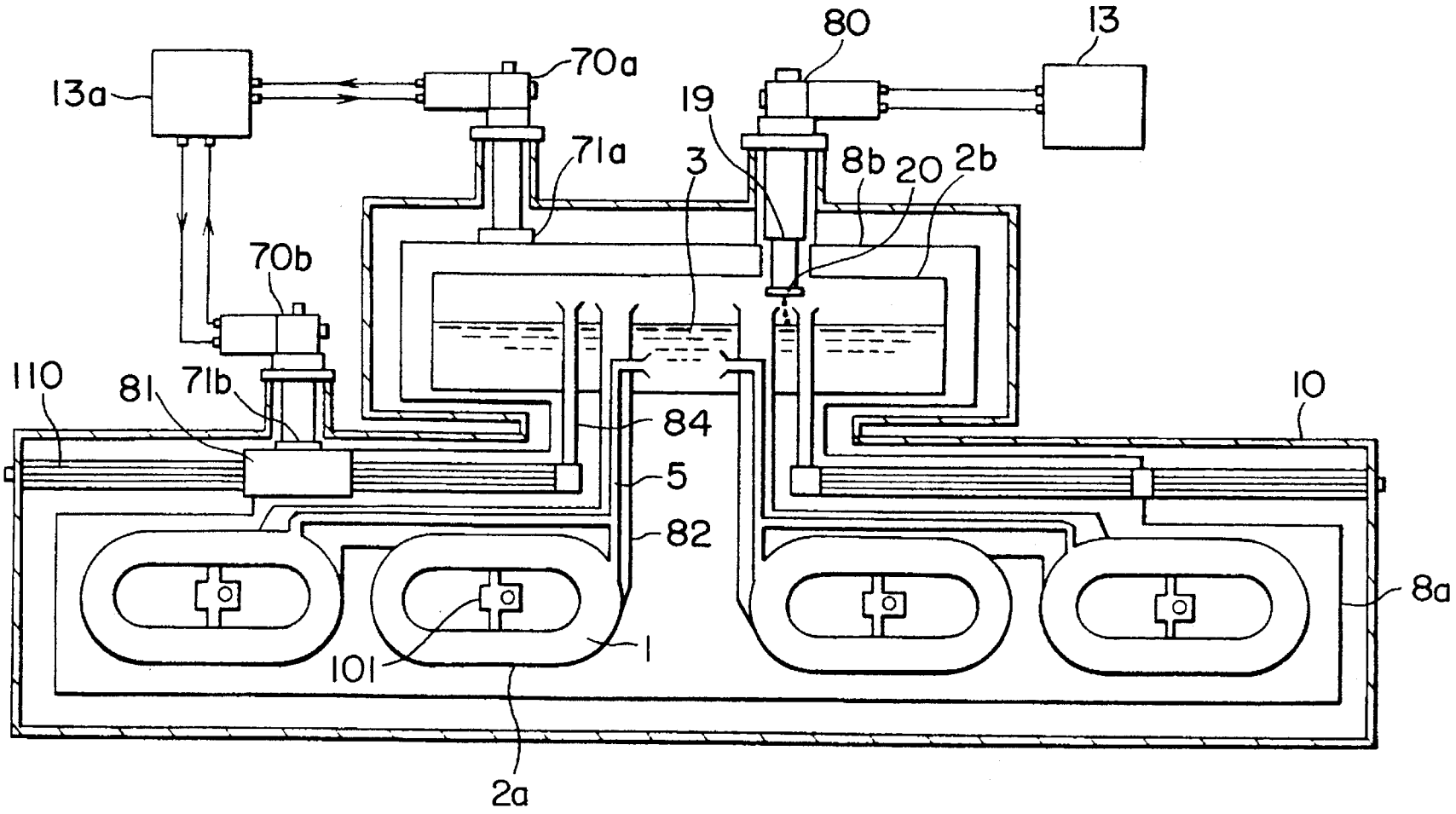
FIG. 16 is a sectional view showing a superconducting magnet according to Embodiment 11 of the present invention.

In Embodiment 11, the present invention is applied to a superconducting magnet for a magnetic levitated ground transportation system. FIG. 16 is a sectional view showing the superconducting magnet according to Embodiment 11 of the present invention. Construction of Embodiment 11 is similar to the above described Embodiment 10 except that the coil portion second single stage type Gifford-McMahon cycle refrigerator 70c is removed and the coil portion thermal shield 8a and the current lead 110 are cooled by the first-stage heat stage 71b of the coil portion single stage type Gifford-McMahon cycle refrigerator 70b.

The current lead 110 is cooled as the helium gas evaporated in the coil portion helium tank 2a and the helium reservoir tank 2b flows through a current lead cooling piping 84. However, when the evaporating amount of the liquid helium 3 is reduced, the cooling effect by the current lead cooling piping 84 is lowered, whereby temperature of the current lead 110 rises and heat penetration into the coil portion helium tank 2a is increased. As a result, the evaporating amount of the liquid helium 3 cannot be less than a certain level. According to Embodiment 11, since the current lead 110 is cooled by the first-stage heat stage 71b of the coil portion first single stage type Gifford-McMahon cycle refrigerator 70b, temperature rise of the current lead may be controlled and heat penetration into the coil portion helium tank 2a may be reduced.

Embodiment 12

Figure 17:
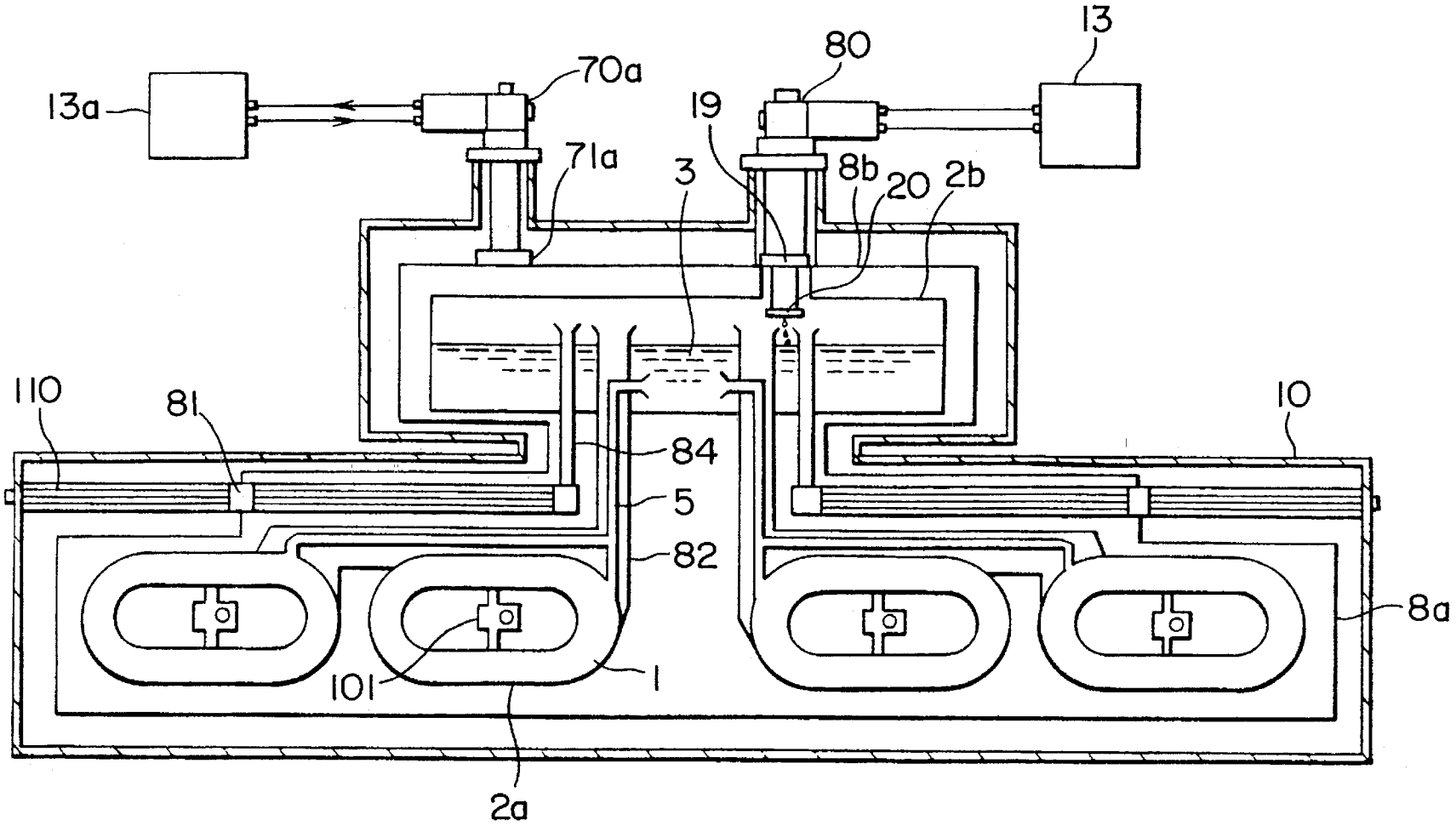
FIG. 17 is a sectional view showing a superconducting magnet according to Embodiment 12 of the present invention.

In Embodiment 12, the present invention is applied to a superconducting magnet for a magnetic levitated ground transportation system. FIG. 17 is a sectional view showing the superconducting magnet according to Embodiment 12. Construction of Embodiment 12 is similar to the above described Embodiment 9 except that the helium reservoir portion thermal shield 8b is cooled by the first-stage heat stage 19 of the helium liquefying 2-stage type Gifford-McMahon cycle refrigerator 80.

According to Embodiment 12, since the helium reservoir portion thermal shield 8b is cooled by the first-stage heat stage 19 of the helium liquefying 2-stage type Gifford-McMahon cycle refrigerator 80, cooling capacity for the helium reservoir portion thermal shield 8b is improved and temperature of the helium reservoir portion thermal shield 8b is lowered. Thereby, heat penetration into the helium reservoir tank 2b is reduced and the evaporating amount of liquid helium 3 is furthermore reduced.

Embodiment 13

Figure 18:
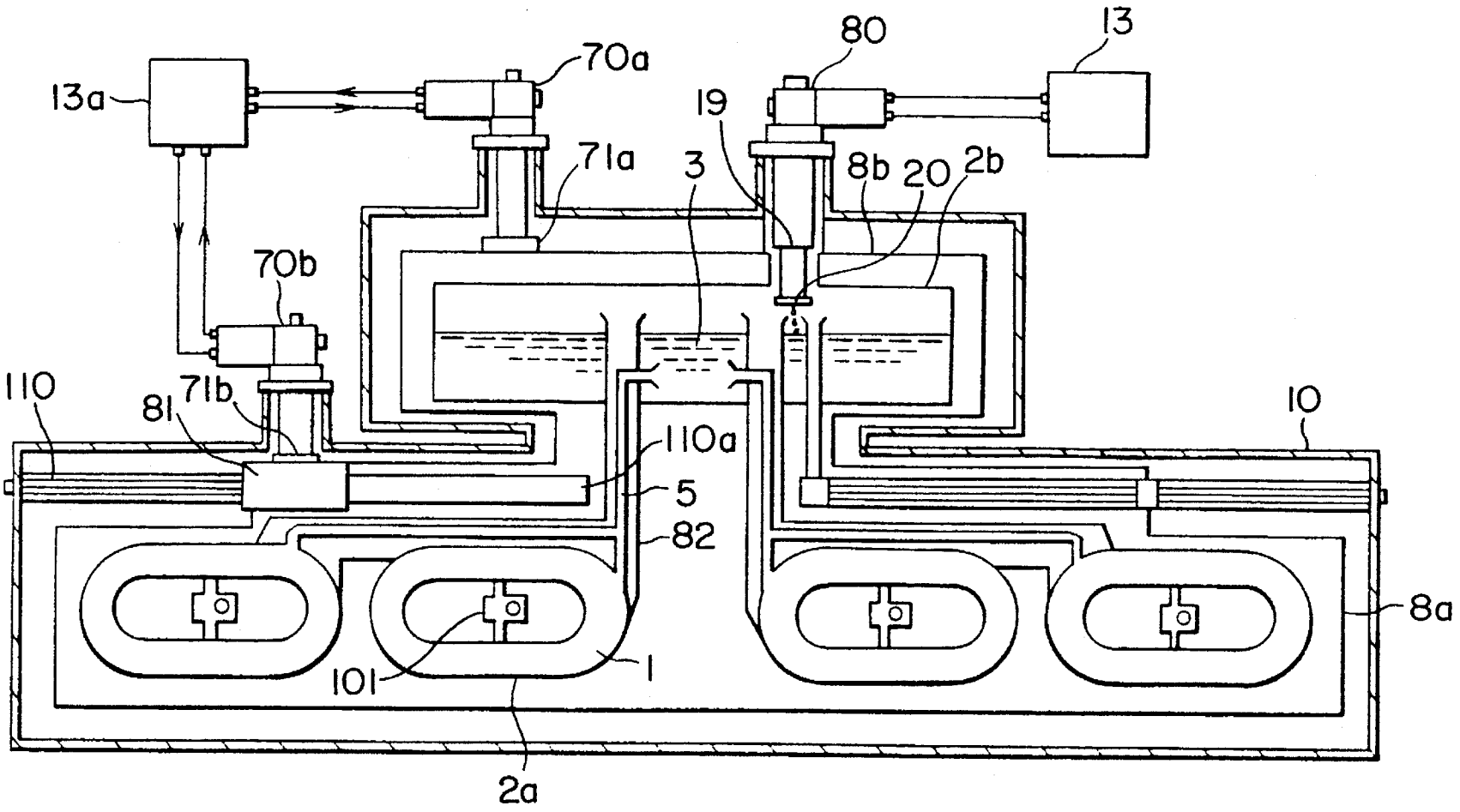
FIG. 18 is a sectional view showing a superconducting magnet according to Embodiment 13 of the present invention.

In Embodiment 13, the present invention is applied to a superconducting magnet of a magnetic levitated ground transportation system. FIG. 18 is a sectional view showing the superconducting magnet according to Embodiment 13 of the present invention. Construction of Embodiment 13 is similar to the above described Embodiment 11 except that the lower temperature side of current lead 110 is constituted by a high-temperature superconducting current lead 110a which is formed from such high-temperature superconductor as Y—Ba—Cu—O, Bi—Sr—Ca—Cu—O, Tl—Ba—Ca—Cu—O or La—Ba—Cu—O. Since current lead 110 is cooled to a temperature of the order of 50K by a thermal anchor 81 and the high-temperature superconducting current lead 110a is located on the lower temperature side thereof, it is in superconducting state. Accordingly, electric resistance of the high-temperature superconducting current lead 110a is zero and thermal conductivity thereof is small. When a current flows through the current lead 110 and the high-temperature superconducting current lead 110a, Joule heat is zero on the low-temperature side of the thermal anchor 81 and thermal loss thereof due to heat conduction is small. Thus, heat penetration into the coil portion helium tank 2a is reduced and the evaporating amount of liquid helium 3 is also reduced.

Embodiment 14

Figure 19:
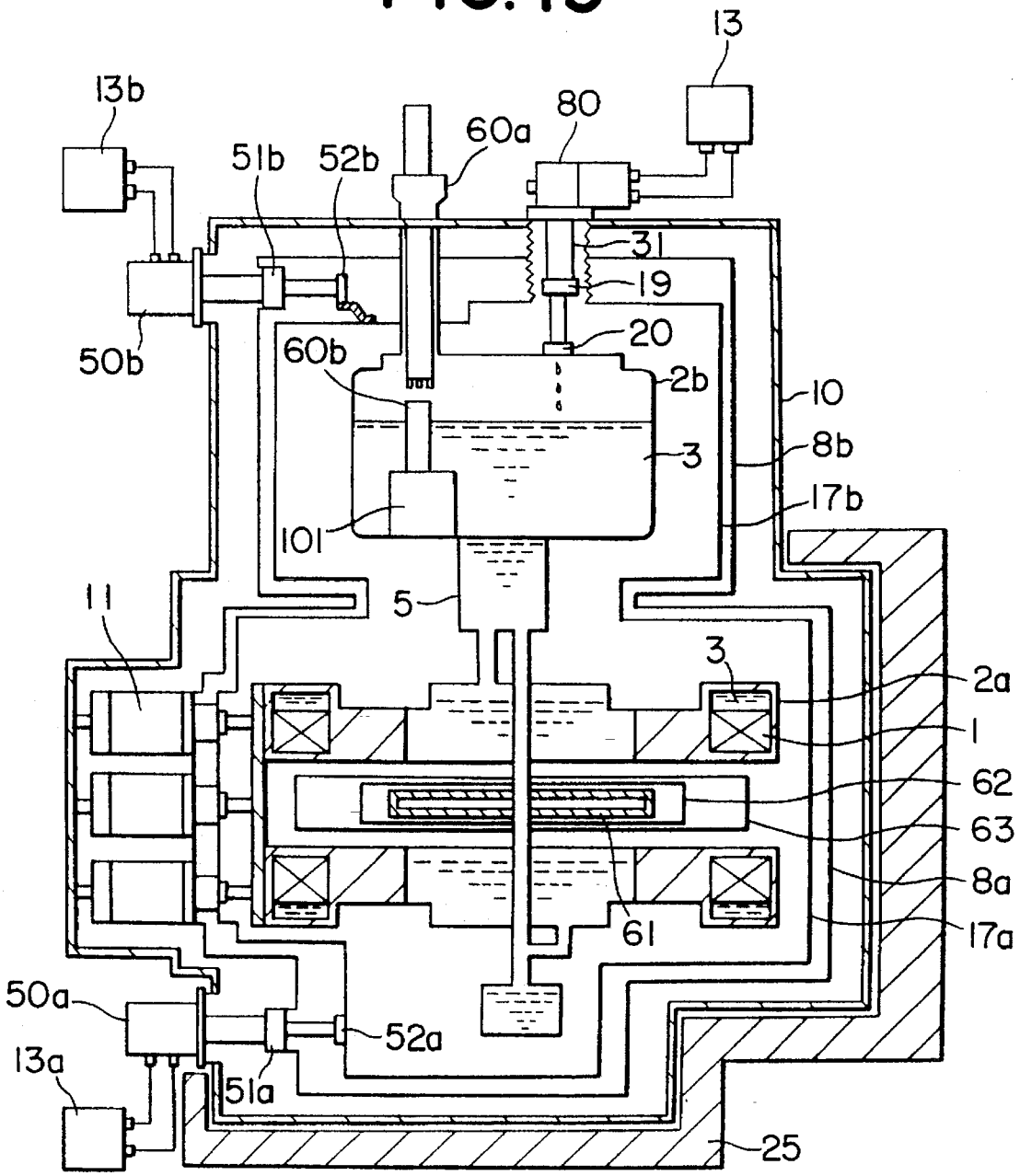
FIG. 19 is a sectional view showing a superconducting magnet according to Embodiment 14 of the present invention.

In Embodiment 14, the present invention is applied to a superconducting magnet of a synchrotron radiation apparatus. FIG. 19 is a sectional view showing the superconducting magnet according to Embodiment 14 of the present invention. In Embodiment 14, of the superconducting magnet according to the above Embodiment 1, the helium liquefying 2-stage type Gifford-McMahon cycle refrigerator 80 is disposed in the vacuum of the vacuum tank 10 so as to effect cooling by causing its second-stage heat stage 20 to abut against a wall surface of the helium reservoir tank 2b.

According to Embodiment 14, the helium gas evaporated within the helium tank 2b is liquefied again when brought into contact with the wall surface of the helium reservoir tank 2b. Then, since a cylinder 31 of the helium liquefying 2-stage type Gifford-McMahon cycle refrigerator 80 is disposed within the vacuum, convective heat transfer around the cylinder 31 may be eliminated and thermal loss thereof may be reduced. As a result, evaporation of liquid helium 3 may be furthermore reduced.

Embodiment 15

Figure 20:
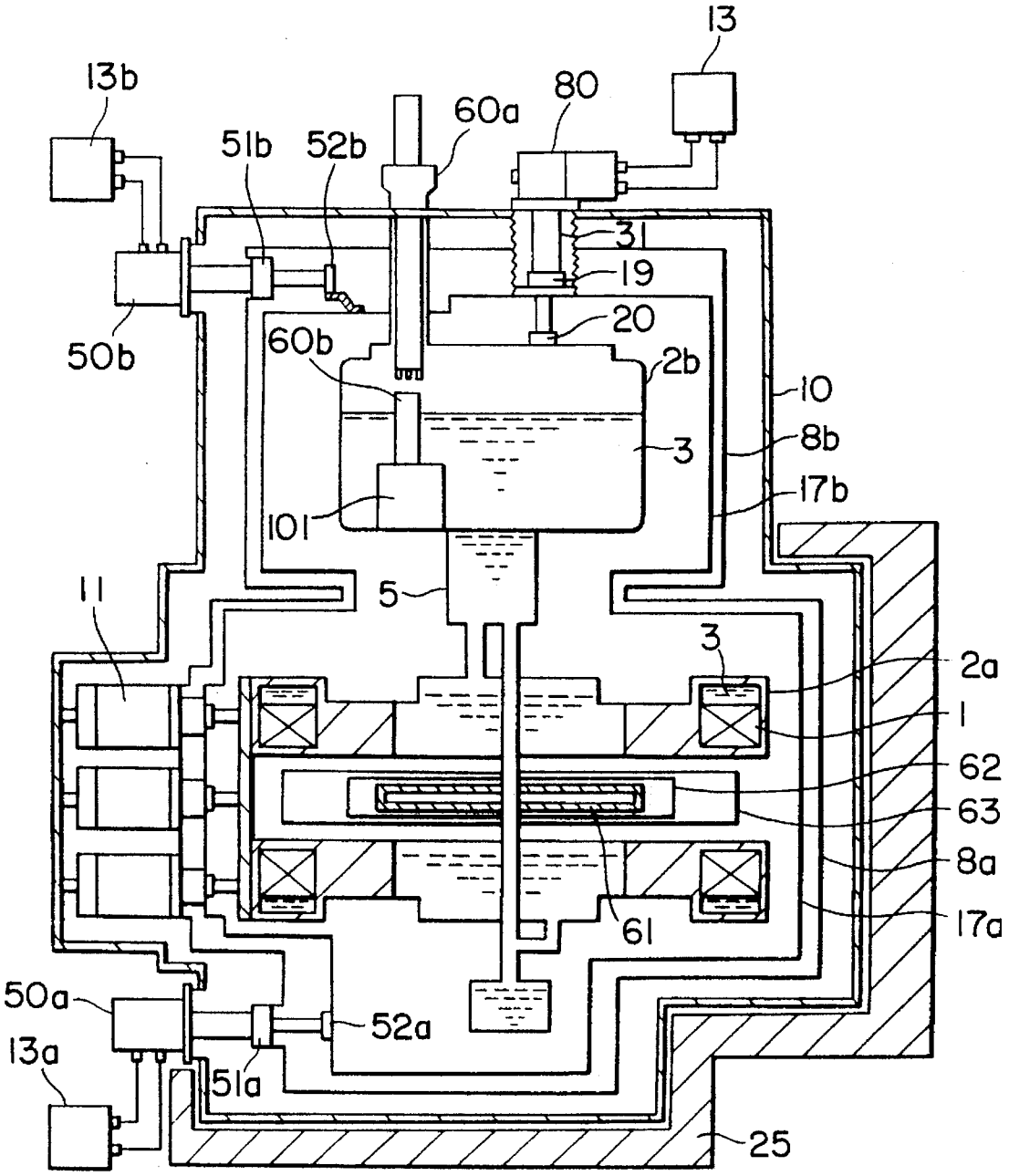
FIG. 20 is a sectional view showing a superconducting magnet according to Embodiment 15 of the present invention.

In Embodiment 15, the present invention is applied to a superconducting magnet of a synchrotron radiation apparatus. FIG. 20 is a sectional view showing the superconducting magnet according to Embodiment 15 of the present invention. Construction of Embodiment 15is similar to the above described Embodiment 14except that the helium reservoir portion thermal shield 17*b* is cooled by the first-stage heat stage 19 of the helium liquefying 2-stage type Gifford-McMahon cycle refrigerator 80.

According to Embodiment 15, the first-stage heat stage 19 of the helium liquefying 2-stage type Gifford-McMahon cycle refrigerator 80 and the helium reservoir portion thermal shield 17*b* are thermally connected to each other. Thus, the helium reservoir portion thermal shield 17*b* is furthermore cooled to a lower temperature. Heat penetration into the helium reservoir tank 2*b* may be reduced and evaporation of liquid helium 3 may be reduced.

Embodiment 16

Figure 21:
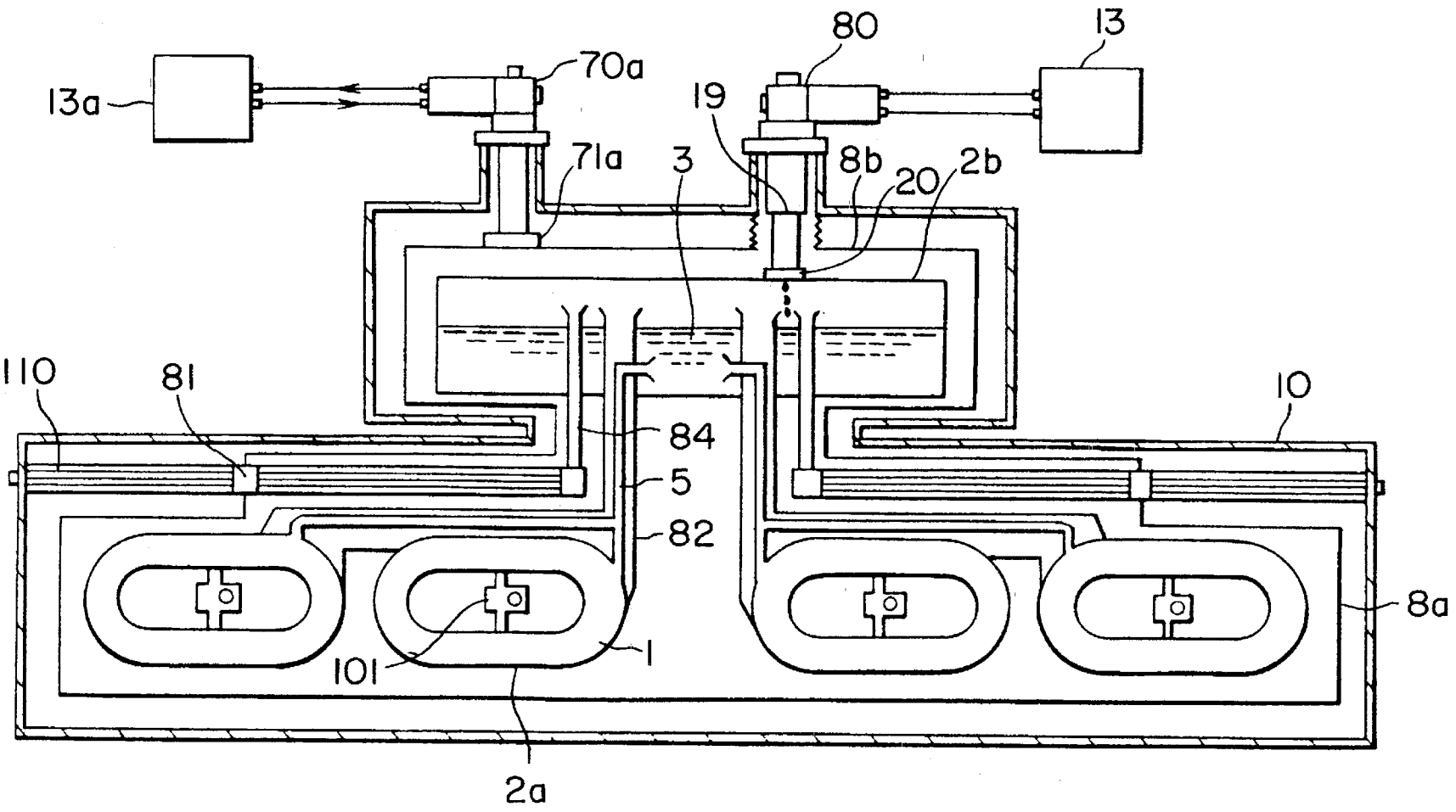
FIG. 21 is a sectional view showing a superconducting magnet according to Embodiment 16 of the present invention.

In Embodiment 16, the present invention is applied to the superconducting magnet of a magnetic levitated ground transportation system. FIG. 21 is a sectional view showing the superconducting magnet according-to Embodiment 16 of the present invention. In Embodiment 16, the cryogenic refrigerant tank is constituted from a coil portion helium tank 2*a* and a helium reservoir tank 2*b*. The thermal shield is constituted by a coil portion thermal shield 8*a* and a helium reservoir portion thermal shield 8*b*. The helium reservoir portion thermal shield 8*b* is cooled by a first-stage heat stage 71*a* of a helium reservoir portion single stage type Gifford-McMahon cycle refrigerator 70*a*, and a wall surface of the helium reservoir tank 2*b* is cooled by a second-stage heat stage 20 of a helium liquefying 2-stage type Gifford-McMahon cycle refrigerator 80.

In this manner, according to Embodiment 16, the helium reservoir portion thermal shield 8*b* may be cooled by the helium reservoir portion single stage type Gifford-McMahon cycle refrigerator 70*a* to control heat penetration into the helium reservoir tank 2*b*. The wall surface of the helium reservoir tank 2*b* is cooled by the helium liquefying 2-stage type Gifford-McMahon cycle refrigerator 80 so that the helium gas evaporated in the helium reservoir tank 2*b* is liquefied as it is brought into contact with the wall surface of the helium reservoir tank 2*b*. Further, since the wall surface of the helium reservoir tank 2*b* is cooled by the helium liquefying 2-stage type Gifford-McMahon cycle refrigerator 80 which is separate from the helium reservoir portion single stage type Gifford-McMahon cycle refrigerator 70*a*, highly efficient operation is possible by optimizing the cycle frequencies of the respective refrigerators. Cooling capacity may be improved to reduce the evaporating amount of liquid helium 3. An interval between replenishments of the liquid helium 3 may be greatly extended to facilitate maintenance.

Embodiment 17

Figure 22:
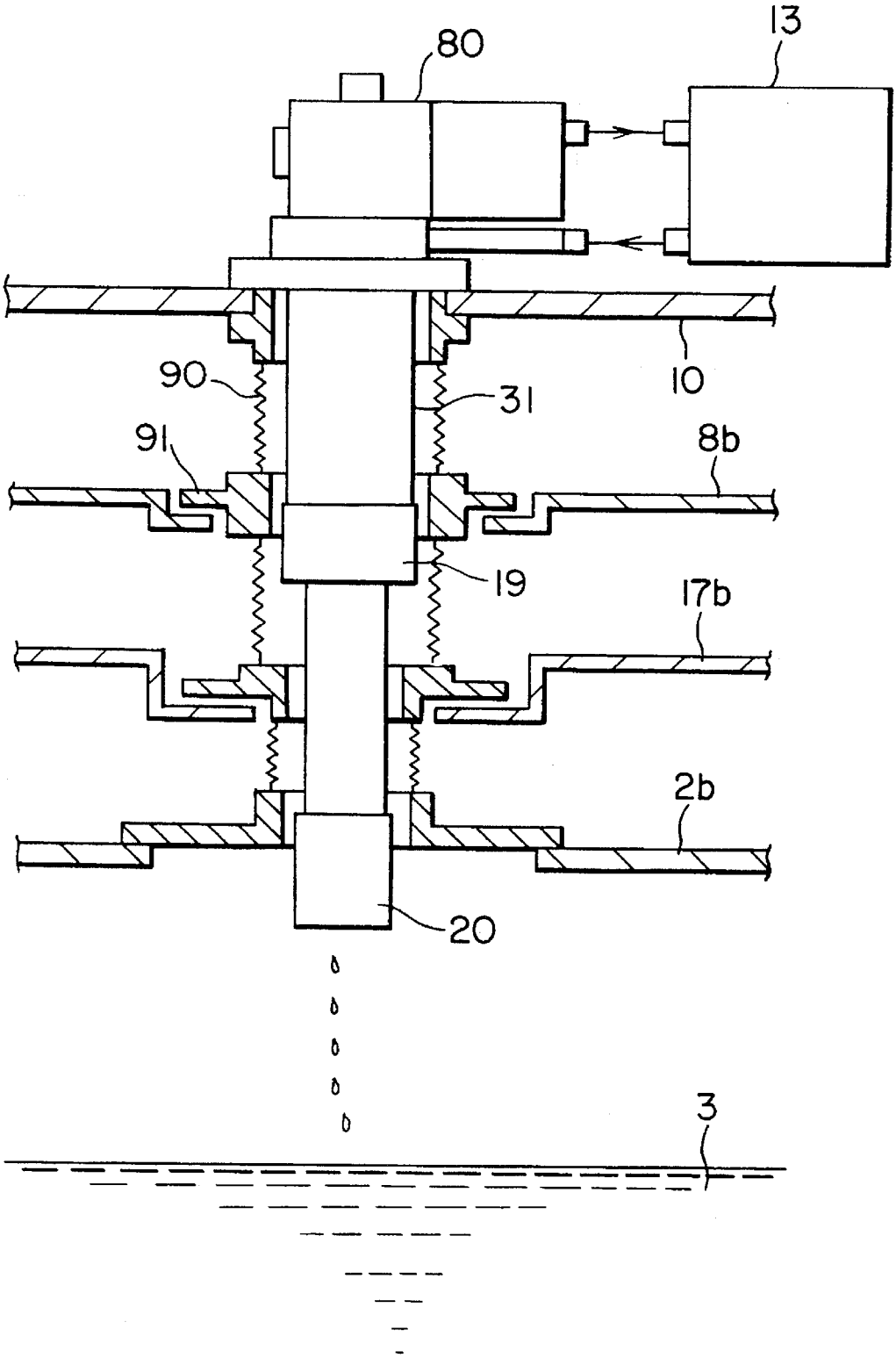
FIG. 22 is a sectional view of certain portions showing a superconducting magnet according to Embodiment 17 of the present invention.

FIG. 22 a sectional view showing certain portions of a superconducting magnet according to Embodiment 17 of the present invention.

In this figure, bellows tube 90 is opened at one end to the atmospheric side and is opened at the other end to the vapor-phase portion of a helium reservoir tank 2*b*, and a radiation shielding plate 91 is attached thereto. The bellows tube 90 is disposed with a separation from and without thermal contact to a helium reservoir portion thermal shield 8*b* and a helium reservoir portion second thermal shield 17*b*.

In Embodiment 17, a helium liquefying 2-stage type Gifford-McMahon cycle refrigerator 80 is mounted so that it faces the interior of the helium reservoir tank 2*b* from the atmospheric side opening end of the bellows tube 90 disposed in a thermally separated manner from the helium reservoir portion thermal shield 8*b* and the helium reservoir portion second thermal shield 17*b*.

According to Embodiment 17, since the bellows tube 90 is disposed without contact to the helium reservoir portion thermal shield 8*b* and the helium reservoir portion second thermal shield 17*b*, the bellows tube 90 has a temperature distribution identical to that of the cylinder 31 of the helium liquefying 2-stage type Gifford-McMahon cycle refrigerator 80, whereby no natural convection occurs between the bellows tube 90 and the cylinder Accordingly, there is no increase in heat penetration due to convection within the bellows tube 90. Further, while the radiation shielding plate 91 is not in contact with the helium reservoir portion thermal shield 8*b* and the helium reservoir portion second thermal shield 17*b*, radiation from the vacuum tank 10 does not penetrate into the helium reservoir tank 2*b* because an overlapping portion is provided. As a result, placement of the helium liquefying 2-stage type Gifford-McMahon cycle refrigerator 80 in the superconducting magnet does not cause any increase in heat penetration.

Embodiment 18

Figure 23:
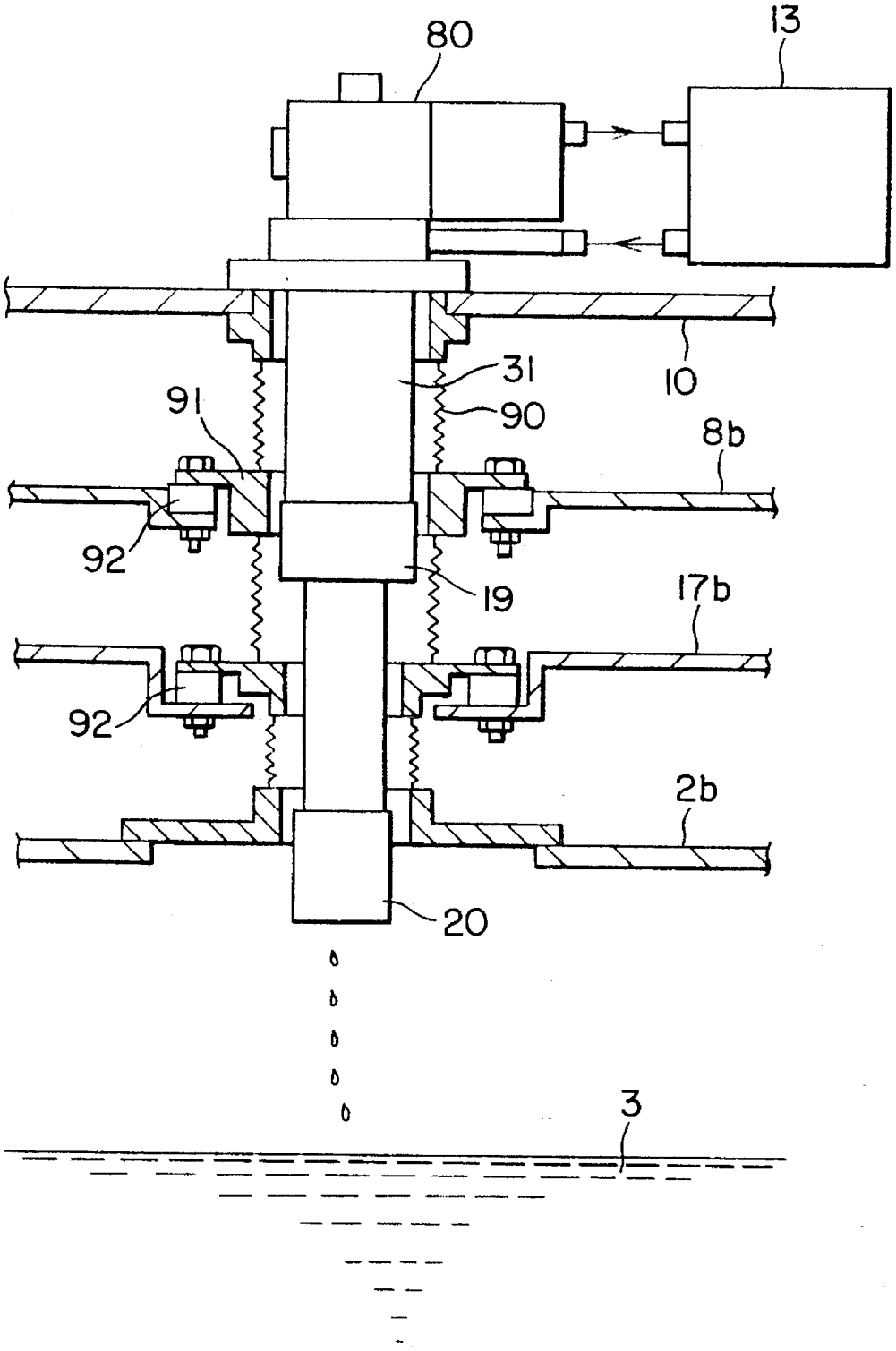
FIG. 23 is a sectional view of certain portions showing a superconducting magnet according to Embodiment 18 of the present invention.

FIG. 23 is a sectional view of certain portions showing a superconducting magnet according to Embodiment 18. In this figure, heat insulating members 92 formed for example from grass epoxy resin or phenol resin are disposed between the radiation shielding plate 91 and the helium reservoir portion thermal shield 8*b*, helium reservoir portion second thermal shield 17*b* so as to thermally separate the radiation shielding plate 91 from the helium reservoir portion thermal shield 8*b* and the helium reservoir portion second thermal shield 17*b*. It should be noted that construction of the other portions is similar to Embodiment 17 as described above.

According to Embodiment 18, although the bellows tube 90 is in contact with the helium reservoir portion thermal shield 8*b* and the helium reservoir portion second thermal shield 17*b* through the heat insulating members 92, such contact is thermally similar to non-contact state and an advantage similar to Embodiment 17 may be obtained.

Embodiment 19

Figure 24:
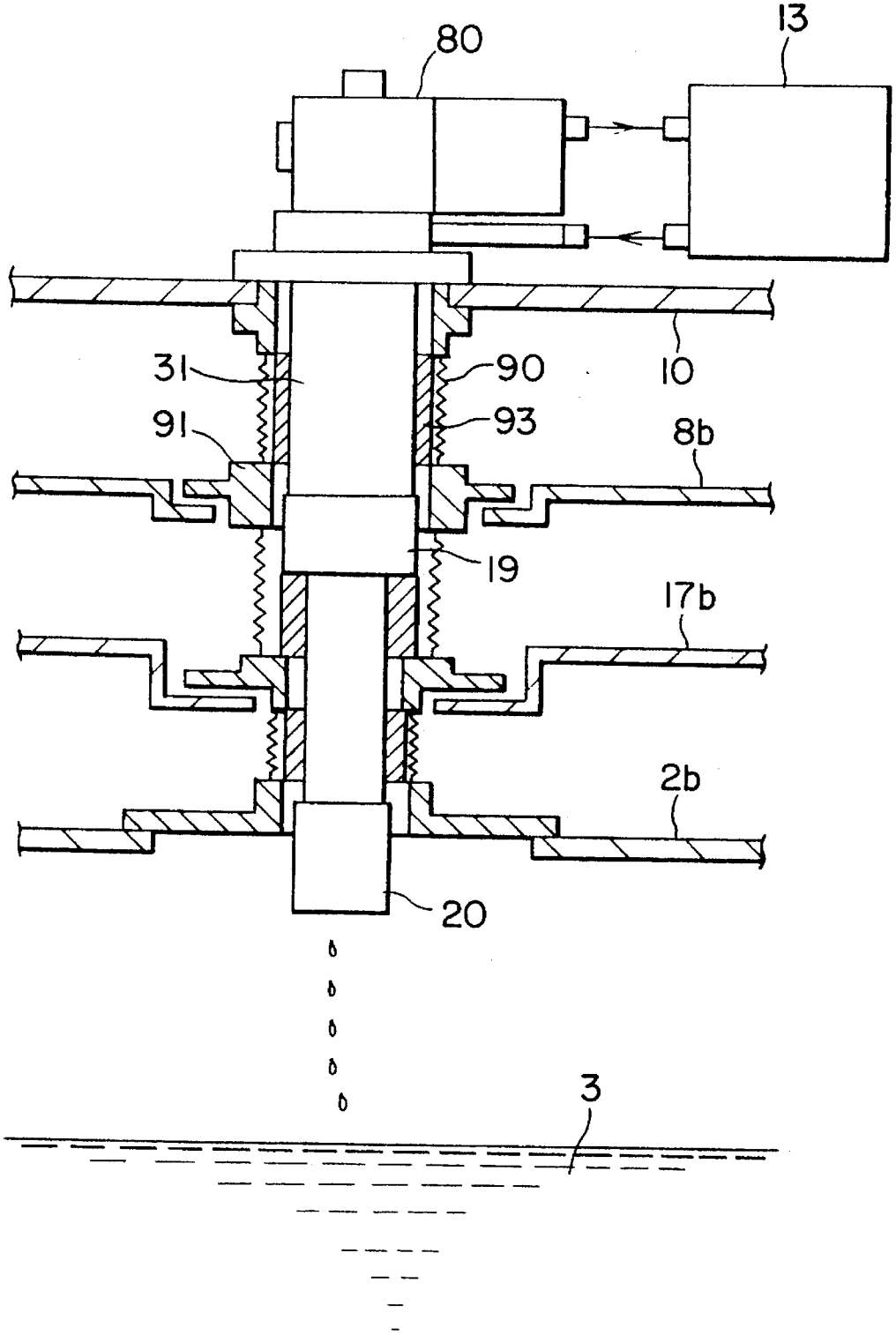
FIG. 24 is a sectional view of certain portions showing a superconducting magnet according to Embodiment 19 of the present invention.

FIG. 24 is a sectional view of certain portions showing a superconducting magnet according to Embodiment 19. In this figure, a convection preventing member 93 for example formed from Styrofoam, a multi-layer insulating material, a felt mat, or natural rubber is disposed between the bellows tube 90 and a cylinder 31 of the helium liquefying 2-stage type Gifford-McMahon cycle refrigerator 80. It should be noted that construction of the other portions is similar to Embodiment 17 as described above.

According to Embodiment 19, convection between the bellows tube 90 and the cylinder 31 of the helium liquefying 2-stage type Gifford-McMahon cycle refrigerator 80 is furthermore prevented by the convection preventing member 93 to reduce even more heat penetration into the helium reservoir tank 2*b*.

Embodiment 20

Figure 25:
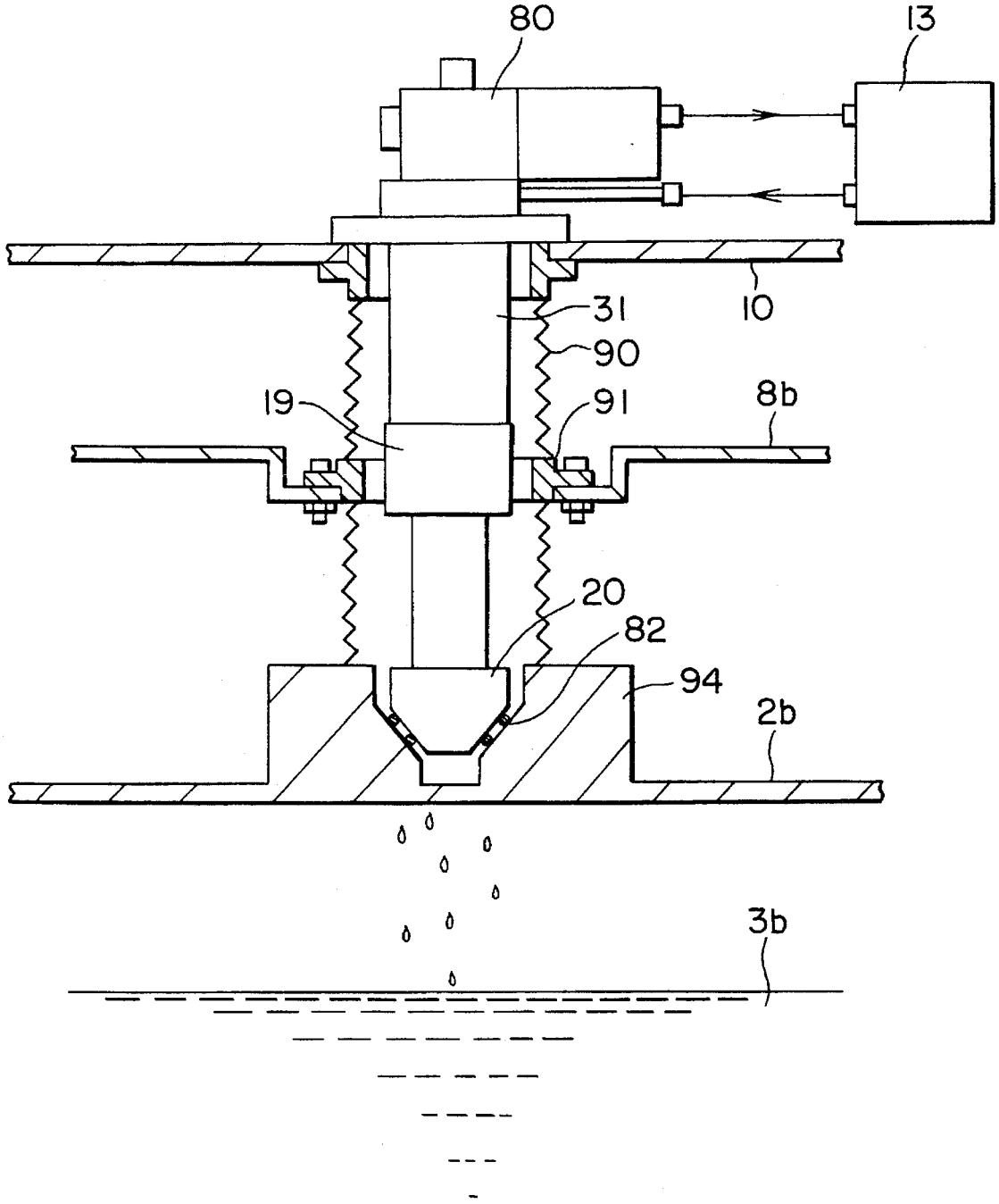
FIG. 25 is a sectional view of certain portions showing a superconducting magnet according to Embodiment 20 of the present invention.

FIG. 25 is a sectional view showing certain portions of a superconducting magnet according to Embodiment 20 of the present invention. In this figure, a heat conductive block 94 is provided on a wall surface of the helium reservoir tank 2*b*, and refrigeration generated at the second-stage heat stage 20 of the helium liquefying 2-stage type Gifford-McMahon cycle refrigerator 80 is transferred to the helium reservoir tank 2*b* through the heat conductive block 94.

In Embodiment 20, the second-stage heat stage 20 and the heat conductive block 94 are tapered and the second-stage heat stage 20 is disposed on the heat conductive block 94 while being slid thereon. Further, soft metal 182 is placed between the second-stage heat stage 20 and the heat conductive block 94 to improve thermal contact thereof. Thus, refrigeration generated at the second-stage heat stage 20 of the helium liquefying 2-stage type Gifford-McMahon cycle refrigerator 80 may be efficiently transferred to the helium reservoir tank 2*b*.

It should be noted that, while the Gifford-McMahon cycle refrigerator are used as the regenerative refrigerator in the above embodiments, those referred herein to as Gifford-McMahon cycle refrigerator include, in addition to a regenerative refrigerator operated in the Gifford-McMahon cycle, a regenerative refrigerator operated in the Modified Solvay cycle which is similar to the Gifford-McMahon cycle.

Further, while Gifford-McMahon cycle refrigerators are used as the regenerative refrigerators in the above embodiments, the regenerative refrigerator is not limited to a Gifford-McMahon cycle refrigerator and, for example, a Stirling refrigerator, a pulse tube refrigerator or a Vuilleumier refrigerator may be suitably used.

What is claimed is:

1. A superconducting magnet comprising:

a superconducting coil;

a coil portion cryogenic refrigerant tank containing said superconducting coil and storing a cryogenic refrigerant;

a cryogenic refrigerant reservoir tank provided in communication with said coil portion cryogenic refrigerant tank to supply said cryogenic refrigerant to said coil portion cryogenic refrigerant tank;

a refrigerant reservoir portion thermal shield enclosing said cryogenic refrigerant reservoir tank;

a coil portion thermal shield enclosing said coil portion cryogenic refrigerant tank;

a vacuum tank enclosing said refrigerant reservoir portion thermal shield and said coil portion thermal shield;

a regenerative refrigerator for cooling said refrigerant reservoir portion thermal shield; and a regenerative refrigerator for cooling said coil portion thermal shield.

2. A superconducting magnet according to claim 1, wherein each of said refrigerant reservoir portion thermal shield and said coil portion thermal shield is constituted by a double thermal shield, and said both regenerative refrigerators are 2-stage type Gifford-McMahon cycle refrigerators.

3. A superconducting magnet according to claim 1, wherein each of said refrigerant reservoir portion thermal shield and said coil portion thermal shield is constituted by a single thermal shield, and said both regenerative refrigerators are single stage type Gifford-McMahon cycle refrigerators.

4. A superconducting magnet comprising:

a beam chamber;

a pair of superconducting coils provided at upper and lower portions of said beam chamber in a thermally separated manner;

a coil portion cryogenic refrigerant tank containing said superconducting coil and storing a cryogenic refrigerant;

a cryogenic refrigerant reservoir tank provided in communication with said coil portion cryogenic refrigerant tank to supply said cryogenic refrigerant to said coil portion cryogenic refrigerant tank;

a refrigerant reservoir portion thermal shield enclosing said cryogenic refrigerant reservoir tank;

a coil portion thermal shield enclosing said coil portion cryogenic refrigerant tank;

a vacuum tank enclosing said refrigerant reservoir portion thermal shield and said coil portion thermal shield;

a regenerative refrigerator for cooling said refrigerant reservoir portion thermal shield; and a regenerative refrigerator for cooling said coil portion thermal shield.

5. A superconducting magnet according to claim 4, wherein each of said refrigerant reservoir portion thermal shield and said coil portion thermal shield is constituted by a double thermal shield, and said both regenerative refrigerators are 2-stage type Gifford-McMahon cycle refrigerators.

6. A superconducting magnet according to claim 4, wherein each of said refrigerant reservoir portion thermal shield and said coil portion thermal shield is constituted by a single thermal shield, and said both regenerative refrigerators are single stage type Gifford-McMahon cycle refrigerators.

7. A superconducting magnet comprising:

a superconducting coil;

a cryogenic refrigerant tank containing said superconducting coil and storing a cryogenic refrigerant;

a thermal shield enclosing said cryogenic refrigerant tank;

a vacuum tank enclosing said thermal shield;

a regenerative refrigerator for cooling said thermal shield; and a regenerative refrigerator for liquefying evaporated gas of said cryogenic refrigerant by exposing at least a portion of its heat stage to a vapor-phase portion of said cryogenic refrigerant tank.

8. A superconducting magnet according to claim 7, wherein said regenerative refrigerator for liquefying evaporated gas of said cryogenic refrigerant comprising: two stages of cylinders; two stages of displacers reciprocating within said two stages of cylinders; first-stage and second-stage expansion spaces constituted by said two stages of cylinders and said two stages of displacers; two stages of regenerators for effecting heat exchange of gas flowing in/out to/from said first-stage and second-stage expansion spaces; a driving motor for causing reciprocation of said two stages of displacers; a valve mechanism for controlling gas flow to said first-stage and second-stage expansion spaces; and a compressor for supplying gas to said first-stage and second-stage expansion spaces; and wherein volume ratio of said fist-stage expansion space to said second-stage expansion space is in the range of 0.45 to 2.8.

9. A superconducting magnet according to claim 7, wherein a bellows tube is mounted in a manner thermally separated from said thermal shield, being opened at one end thereof to the atmospheric side and opened at the other end thereof to a vapor phase portion of said cryogenic refrigerant tank, and wherein said regenerative refrigerator for liquefying evaporated gas of said cryogenic refrigerant is mounted from the atmospheric side opening end of said bellows tube so that a heat stage of said regenerative refrigerator for liquefying evaporated gas of said cryogenic refrigerant faces said cryogenic refrigerant tank.

10. A superconducting magnet comprising:

a superconducting coil;

a cryogenic refrigerant tank containing said superconducting coil and storing a cryogenic refrigerant;

a thermal shield enclosing said cryogenic refrigerant tank;

a vacuum tank enclosing said thermal shield;

a regenerative refrigerator for cooling said thermal shield; and a regenerative refrigerator for cooling said cryogenic refrigerant tank by thermally connecting at least a portion of its heat stage to a wall surface of said cryogenic refrigerant tank.

11. A superconducting magnet according to claim 10, wherein said regenerative refrigerator for cooling said cryogenic refrigerant tank comprising: two stages of cylinders; two stages of displacers reciprocating within said two stages of cylinders; first-stage and second-stage expansion spaces constituted by said two stages of cylinders and said two stages of displacers; two stages of regenerators for effecting heat exchange of gas flowing in/out to/from said first-stage and second-stage expansion spaces; a driving motor for causing reciprocation of said two stages of displacers; a valve mechanism for controlling gas flow to said first-stage and second-stage expansion spaces; and a compressor for supplying gas to said first-stage and second-stage expansion spaces; and wherein volume ratio of said fist-stage expansion space to said second-stage expansion space is in the range of 0.45 to 2.8.

* * * * *